US010385724B2

(12) United States Patent
Vogt et al.

(10) Patent No.: US 10,385,724 B2
(45) Date of Patent: Aug. 20, 2019

(54) TOOLS AND METHODS FOR CLEANING GROOVES OF A TURBINE ROTOR DISC

(71) Applicant: General Electric Company, Schenectady, NY (US)

(72) Inventors: Ernst Vogt, Remigen (CH); Fabian Gubelmann, Buchs (CH); Roman Stefan Peter, Etzgen (CH)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/471,383

(22) Filed: Mar. 28, 2017

(65) Prior Publication Data

US 2018/0283208 A1 Oct. 4, 2018

(51) Int. Cl.
*F01D 25/00* (2006.01)
*B08B 1/00* (2006.01)
(Continued)

(52) U.S. Cl.
CPC ..... *F01D 25/002* (2013.01); *B08B 1/002* (2013.01); *B08B 1/005* (2013.01); *B08B 1/006* (2013.01);
(Continued)

(58) Field of Classification Search
CPC ..... F01D 25/002; B08B 1/00; B08B 1/001; B08B 1/002; B08B 1/003; B08B 1/005; B08B 1/006; B08B 9/00; B08B 2209/00; B08B 2240/00; A46B 2200/30; A46B 2200/3006; A46B 2200/3013; A46B 2200/3073; A46B 2200/3093
USPC .. 15/104.001, 104.16, 160, 164, 202, 210.1, 15/211, 221, 223, 224, 236.05–236.09, 15/244.1
See application file for complete search history.

(56) References Cited

U.S. PATENT DOCUMENTS 172,996 A * 2/1876 Gregg ..... 15/104.16
964,355 A * 7/1910 Wilson ..... 15/223
(Continued)

FOREIGN PATENT DOCUMENTS

| | | |
|---|---|---|
| CN | 202749977 U | 2/2013 |
| DE | 1912916 | 9/1970 |
| DE | 10 2015 214 999 A1 | 2/2017 |
| EP | 18162226 | 12/2006 |

OTHER PUBLICATIONS

Extended Search Report and Written Opinion issued in connection with corresponding EP 18162226.7, dated Feb. 18, 2019 (12 pp.).

*Primary Examiner* — Mark Spisich
(74) *Attorney, Agent, or Firm* — Eversheds Sutherland (US) LLP

(57) ABSTRACT

The present application provides a tool for cleaning a groove of a turbine rotor disk. The tool may include a pair of guides spaced apart from one another in a direction of a longitudinal axis of the tool, and a number of cleaning sheets positioned between the guides in the direction of the longitudinal axis of the tool. At least a portion of each guide may have a cross-sectional profile corresponding to a cross-sectional profile of the groove, and at least a portion of each cleaning sheet may have a cross-sectional profile corresponding to the cross-sectional profile of the groove. The present application further provides a method for cleaning a groove of a turbine rotor disk, and a tool system for cleaning a groove of a turbine rotor disk.

11 Claims, 14 Drawing Sheets

(51) Int. Cl.

| | |
|---|---|
| ***F01D 5/30*** | (2006.01) |
| ***B08B 1/04*** | (2006.01) |
| ***B08B 9/00*** | (2006.01) |
| ***B24D 15/02*** | (2006.01) |
| ***B24B 23/02*** | (2006.01) |
| ***B24B 27/033*** | (2006.01) |
| ***B24B 29/00*** | (2006.01) |
| ***B24B 29/02*** | (2006.01) |
| ***B24D 15/04*** | (2006.01) |
| *F01D 5/02* | (2006.01) |

(52) U.S. Cl.

CPC ..... *B08B 1/008* (2013.01); *B08B 1/04* (2013.01); *B08B 9/00* (2013.01); *B24B 23/028* (2013.01); *B24B 27/033* (2013.01); *B24B 29/005* (2013.01); *B24B 29/02* (2013.01); *B24D 15/02* (2013.01); *B24D 15/04* (2013.01); *F01D 5/3007* (2013.01); *A46B 2200/3073* (2013.01); *F01D 5/02* (2013.01); *F05D 2220/31* (2013.01); *F05D 2220/32* (2013.01); *F05D 2230/10* (2013.01); *F05D 2230/14* (2013.01); *F05D 2230/72* (2013.01)

(56) References Cited

U.S. PATENT DOCUMENTS

| | | | | |
|---|---|---|---|---|
| 1,382,587 | A * | 6/1921 | Withycombe | A46B 9/005 15/188 |
| 2,870,472 | A * | 1/1959 | Hartmann | A47L 13/25 15/223 |
| 2,957,189 | A | 10/1960 | Nelson et al. | |
| 3,317,944 | A * | 5/1967 | Napier | A46B 11/001 15/223 |
| 5,964,355 | A | 10/1999 | Raura | |
| 6,170,107 | B1 | 1/2001 | George et al. | |
| 7,412,741 | B2 | 8/2008 | Roney et al. | |
| 7,917,988 | B2 * | 4/2011 | Gillott | B05C 17/00 15/210.1 |
| 8,157,620 | B2 | 4/2012 | Corn et al. | |
| 2003/0086765 | A1 | 5/2003 | Nolan et al. | |
| 2006/0219483 | A1 | 10/2006 | Gillott et al. | |
| 2009/0007352 | A1 * | 1/2009 | Komine | A47L 13/10 15/104.16 |
| 2013/0185877 | A1 * | 7/2013 | Clark | B08B 1/008 15/104.05 |

* cited by examiner

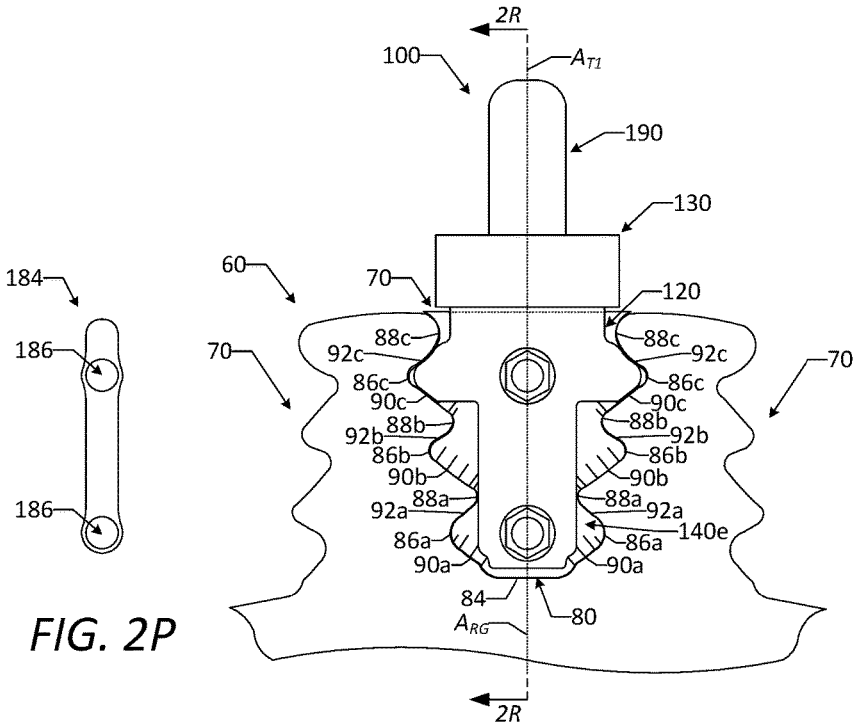
FIG. 2P
FIG. 2Q
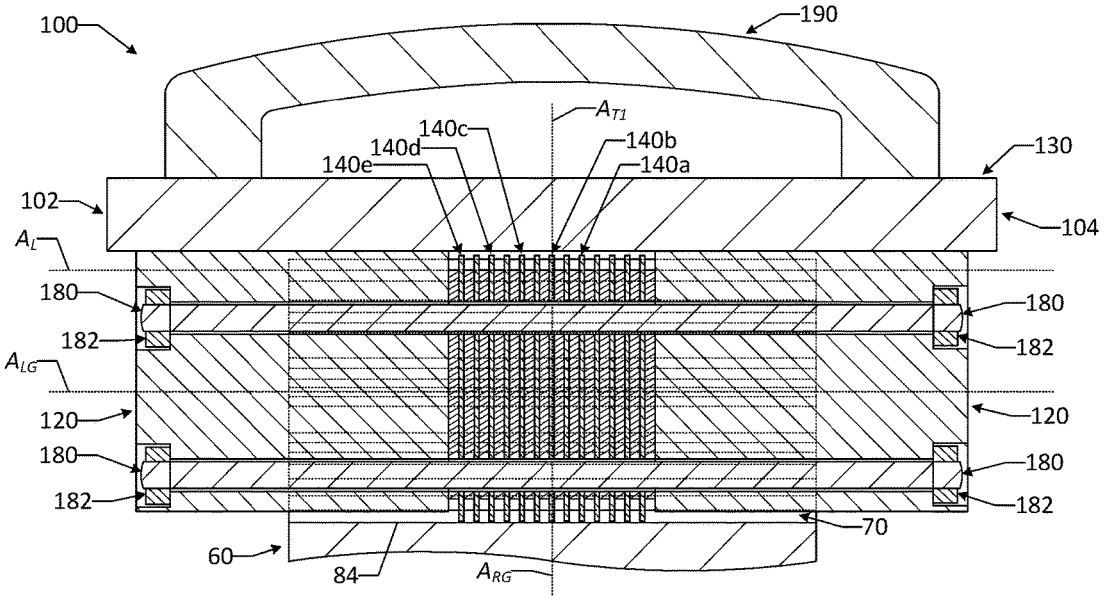
FIG. 2R

TOOLS AND METHODS FOR CLEANING GROOVES OF A TURBINE ROTOR DISC

TECHNICAL FIELD

The present application relates generally to turbine engines and more particularly relate to tools and methods for cleaning grooves of a turbine rotor disc of a gas turbine engine or a steam turbine engine.

BACKGROUND OF THE INVENTION

A turbine for a gas turbine engine or a steam turbine engine may include a number of stages arranged along a longitudinal axis of the turbine. Each stage may include a rotor disk and a number of replaceable turbine blades arranged about an outer circumference of the rotor disk. To facilitate replacement thereof, the turbine blades may be removably attached to the rotor disk via dovetail connections by which root portions of the blades are inserted axially into respective grooves formed along the outer circumference of the rotor disk. Each groove of the rotor disk may have a dovetail shape having a "fir-tree" configuration that includes a number of slots and ribs, and the root portion of each turbine blade may have a mating dovetail shape and fir-tree configuration. In this manner, the root portions of the turbine blades may be retained radially within the respective grooves of the rotor disk during operation of the turbine.

Periodic cleaning may be carried out in order to remove contaminants from various portions of the turbine and ensure efficient turbine operation. For example, hardened dirt, oxidation residue, and/or other contaminants may accumulate within the grooves of the rotor disk during operation of the turbine over a period of time. In some instances, contaminants may pass through cooling air holes of the rotor disk and form sintered material within the grooves of the rotor disk due to the high turbine operating temperature. Cleaning of the rotor disk grooves may be tedious and time-consuming because each groove may include a number of different internal surfaces due to the fir-tree configuration, each rotor disk may include a large number of grooves, and access to the grooves by maintenance personnel may be limited. The rotor disk grooves generally may be cleaned prior to non-destructive testing, inspection, and general cleaning of the rotor, and the rotor may be on the critical path of the overall cleaning process. Accordingly, the amount of time spent cleaning the rotor disk grooves may directly impact the amount of downtime required for cleaning the overall gas turbine engine or steam turbine engine.

According to certain known cleaning methods, contaminants may be removed from the grooves of a rotor disk by hand, using a section of abrasive material to grind away contaminants from each desired surface of each groove. In view of the large number of surfaces, grooves, and rotor disks, such methods may require a substantial amount of time to complete the cleaning of a single turbine and thus may necessitate a long downtime of the turbine engine. Moreover, the quality and effectiveness of such cleaning methods may vary widely, as the degree of contaminant removal achieved may depend largely on the technique of the maintenance personnel carrying out the cleaning. According to other known methods, the rotor disk grooves may be cleaned by ice blasting, which uses compressed air and dry ice to remove contaminants from the grooves as well as other portions of the rotor disk. Such cleaning methods, however, may require expensive ice-blasting equipment and may be very noisy. Moreover, while ice blasting the grooves of a rotor disk, the process may prevent maintenance personnel from simultaneously cleaning or performing other work on other portions of the turbine rotor.

There is thus a desire for improved tools and methods for cleaning the grooves of a turbine rotor disc of a gas turbine engine or a steam turbine engine. Such tools and methods should allow maintenance personnel to quickly and efficiently remove contaminants from all desired surfaces of the rotor disk grooves. Additionally, such tools and methods should ensure that a substantially consistent degree of contaminant removal is achieved from one groove to another, even when the cleaning process is carried out by different maintenance personnel. Furthermore, such tools should be relatively inexpensive and easy to operate, and such methods should allow maintenance personnel to simultaneously clean or perform other work on other portions of the turbine rotor while the rotor disk grooves are being cleaned.

SUMMARY OF THE INVENTION

The present application thus provides a tool for cleaning a groove of a turbine rotor disk. The tool may include a pair of guides spaced apart from one another in a direction of a longitudinal axis of the tool, and a number of cleaning sheets positioned between the guides in the direction of the longitudinal axis of the tool. At least a portion of each guide may have a cross-sectional profile corresponding to a cross-sectional profile of the groove, and at least a portion of each cleaning sheet may have a cross-sectional profile corresponding to the cross-sectional profile of the groove.

The present application further provides a method for cleaning a groove of a turbine rotor disk. The method may include the step of providing a first tool including a pair of guides spaced apart from one another in a direction of a longitudinal axis of the first tool, and a number of cleaning sheets positioned between the guides of the first tool in the direction of the longitudinal axis of the first tool. At least a portion of each guide of the first tool may have a cross-sectional profile corresponding to a cross-sectional profile of the groove, and at least a portion of each cleaning sheet may have a cross-sectional profile corresponding to the cross-sectional profile of the groove. The method also may include the steps of inserting one of the guides of the first tool into the groove in a first direction along a longitudinal axis of the groove, and moving the first tool in the first direction such that the cleaning sheets pass through the groove in the first direction.

The present application further provides a tool system for cleaning a groove of a turbine rotor disk. The tool system may include a first tool and a second tool. The first tool may include a pair of guides spaced apart from one another in a direction of a longitudinal axis of the first tool, and a number of cleaning sheets positioned between the guides of the first tool in the direction of the longitudinal axis of the first tool. At least a portion of each guide of the first tool may have a cross-sectional profile corresponding to a cross-sectional profile of the groove, and at least a portion of each cleaning sheet may have a cross-sectional profile corresponding to the cross-sectional profile of the groove. The second tool may include a pair of guides spaced apart from one another in a direction of a longitudinal axis of the second tool, and a cleaning brush positioned between the guides of the second tool in the direction of the longitudinal axis of the second tool. At least a portion of each guide of the second tool has a cross-sectional profile corresponding to the cross-sectional profile of the groove, and at least a portion of the cleaning brush has a cross-sectional profile corresponding to the cross-sectional profile of the groove.

These and other features and improvements of the present application will become apparent to one of ordinary skill in the art upon review of the following detailed description when taken in conjunction with the several drawings and the appended claims.

BRIEF DESCRIPTION OF THE DRAWINGS

FIG. 2P is an end view of a spacer of the first tool of FIG. 2A.

FIG. 2Q is an end view of the first tool of FIG. 2A positioned within a groove of a rotor disk.

FIG. 2R is a cross-sectional side view of the first tool of FIG. 2A positioned within the groove of the rotor disk of FIG. 2Q, taken along line 2R-2R.

DETAILED DESCRIPTION

Figure 1A:
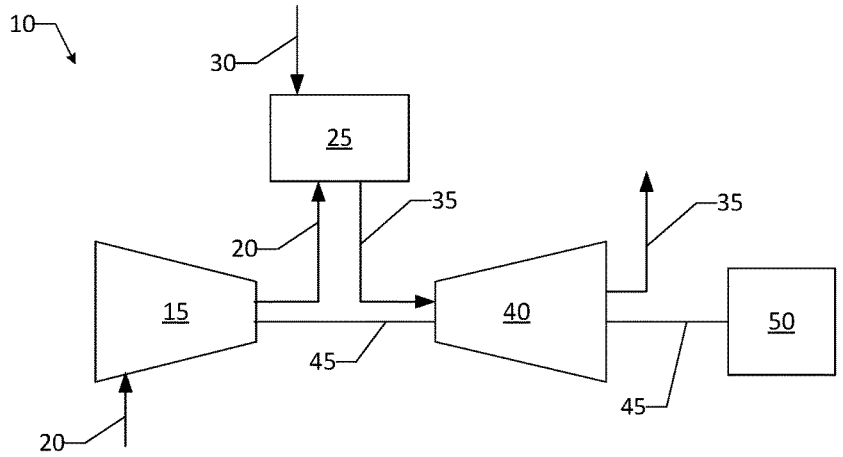
FIG. 1A is a schematic diagram of a gas turbine engine including a compressor, a combustor, a turbine, and an external load.
Figure 1B:
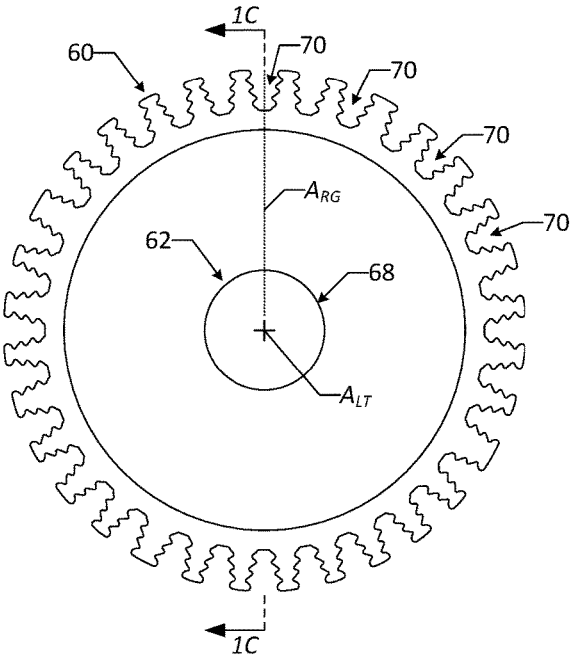
FIG. 1B is an end view of an embodiment of a rotor disk and a rotor shaft as may be described herein and as may be used in the turbine of the gas turbine engine of FIG. 1A, the rotor disk including a number of grooves.
Figure 1C:
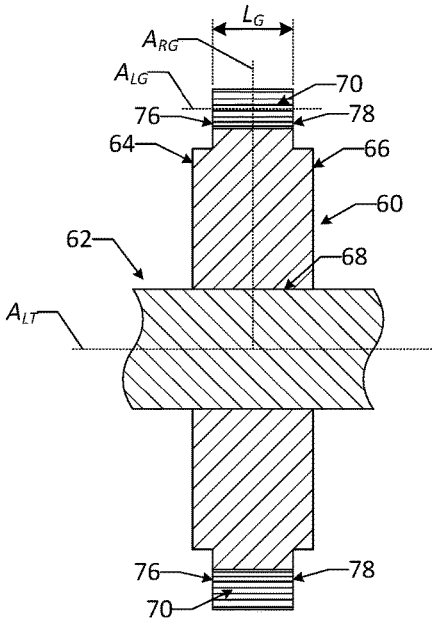
FIG. 1C is a cross-sectional side view of the rotor disk and the rotor shaft of FIG. 1B, taken along line 1C-1C.
Figure 1D:
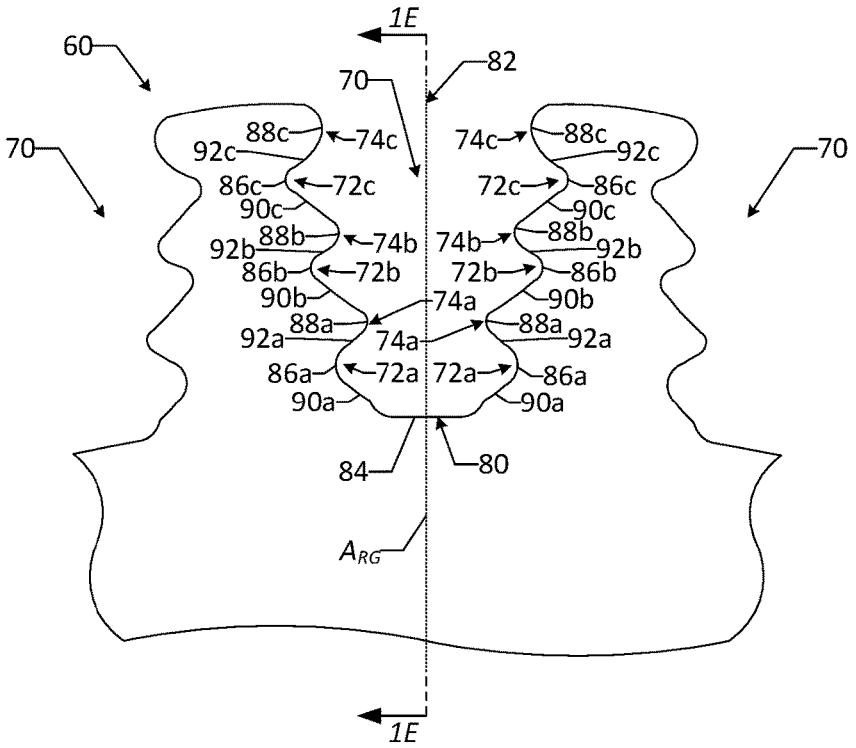
FIG. 1D is a detailed end view of a portion of the rotor disk of FIG. 1B, showing one of the grooves.
Figure 1E:
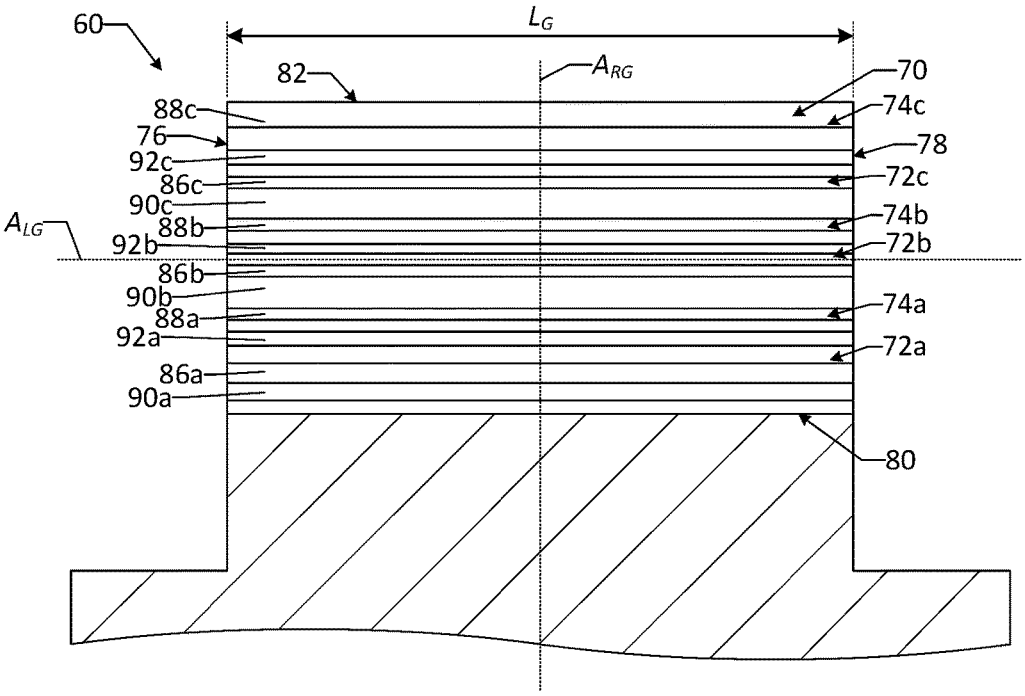
FIG. 1E is a cross-sectional side view of the portion of the rotor disk of FIG. 1D, taken along line 1E-1E.

Referring now to the drawings, in which like numerals refer to like elements throughout the several views, FIG. 1A shows a schematic diagram of a gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15, via a shaft 45, and an external load 50, such as an electrical generator and the like. Other configurations and other components may be used herein.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together. Although the gas turbine engine 10 is shown, the present application may be applicable to any type of turbo machinery.

FIGS. 1B-1E show an embodiment of a rotor disk 60 and a rotor shaft 62 as may be described herein. The rotor disk 60 and the rotor shaft 62 may be used in the turbine 40 of the gas turbine engine 10. Alternatively, the rotor disk 60 and the rotor shaft 62 may be used in a similar manner in a turbine of a steam turbine engine. As shown, the turbine rotor disk 60 and the turbine rotor shaft 62 may be positioned along a longitudinal axis $A_{LT}$ of the turbine 40 such that respective longitudinal axes of the rotor disk 60 and the rotor shaft 62 are coaxial with the longitudinal axis $A_{LT}$ of the turbine 40. The rotor disk 60 generally may be formed as a disk-shaped member having an upstream end 64 and a downstream end 66 opposite the upstream end 64 in the direction of the longitudinal axis $A_{LT}$ of the turbine 40. As shown, the rotor disk 60 may include a central opening 68 defined therein and extending from the upstream end 64 to the downstream end 66 thereof. The rotor shaft 66 generally may be formed as an elongated cylindrical member extending through the central opening 68 of the rotor disk 60. Other configurations of the rotor disk 60 and the rotor shaft 66 may be used herein.

The turbine rotor disk 60 may include a number of grooves 70 formed along an outer circumference of the rotor disk 60 and extending from the upstream end 64 to the downstream end 66 thereof. The grooves 70 may be arranged in a circumferential array about the longitudinal axis of the rotor disk 60 and spaced apart from one another, as shown. Although thirty-two (32) grooves 70 are shown in the illustrated embodiment, the rotor disk 60 may include any number of grooves 70 defined therein in other embodiments. Each groove 70 may be configured to removably receive a root portion of a respective turbine blade therein. In this manner, the rotor disk 60 may support a number of replaceable turbine blades in a circumferential array about the longitudinal axis $A_{LT}$ of the turbine 40. In some embodiments, as shown, each groove 70 may have a straight configuration, extending axially (i.e., from the upstream end 64 to the downstream end 66) in a parallel manner with respect to the longitudinal axis of the rotor disk 60. In other embodiments, each groove 70 may have an angled configuration, extending axially at an acute angle with respect to the longitudinal axis of the rotor disk 60. Other axial configurations and shapes of the grooves 70 may be used herein.

As shown, each groove 70 of the rotor disk 60 may have a dovetail shape having a "fir-tree" configuration, when viewed from one of the ends 64, 66 of the rotor disk 60. In particular, each groove 70 may include a number of slots 72 and a number of ribs 74, as shown, and the root portion of each turbine blade may have a mating dovetail shape including a number of slots and a number of ribs. In this manner, the root portions of the turbine blades may be retained radially within the respective grooves 70 during operation of the turbine 40. In some embodiments, as shown, each groove 70 may include a pair of first slots 72*a* (which also may be referred to as "radially-inner slots"), a pair of second slots 72*b* (which also may be referred to as "radially-intermediate slots"), a pair of third slots 72*c* (which also may be referred to as "radially-outer slots"), a pair of first ribs 74*a* (which also may be referred to as "radially-inner ribs"), a pair of second ribs 74*b* (which also may be referred to as "radially-intermediate ribs"), and a pair of third ribs 74*c* (which also may be referred to as "radially-outer ribs"). Although each groove 70 is shown as including six (6) slots 72 and six (6) ribs 74 in the illustrated embodiment, each groove 70 may include any number of slots 72 and any number of ribs 74 in other embodiments.

Each groove 70 may have a longitudinal axis $A_{LG}$ extending along a length $L_G$ of the groove 70, and a radial axis $A_{RG}$ extending radially from the longitudinal axis of the rotor disk 60 and bisecting the cross-sectional profile (taken perpendicular to the longitudinal axis of the rotor disk 60) of the groove 70. In this manner, the groove 70 may have an upstream end 76, a downstream end 78, a radially inner end 80, and a radially outer end 82. As shown, the first slots 72*a* may be positioned opposite one another with respect to the radial axis $A_{RG}$ of the groove 70, the second slots 72*b* may be positioned opposite one another with respect to the radial axis $A_{RG}$, and the third slots 72*c* may be positioned opposite one another with respect to the radial axis $A_{RG}$. In a similar manner, the first ribs 74*a* may be positioned opposite one another with respect to the radial axis $A_{RG}$ of the groove 70, the second ribs 74*b* may be positioned opposite one another with respect to the radial axis $A_{RG}$, and the third ribs 74*c* may be positioned opposite one another with respect to the radial axis $A_{RG}$. Each of the slots 72*a*, 72*b*, 72*c* and each of the ribs 74*a*, 74*b*, 74*c* may extend from the upstream end 76 to the downstream end 78 of the groove 70.

Figure 1F:
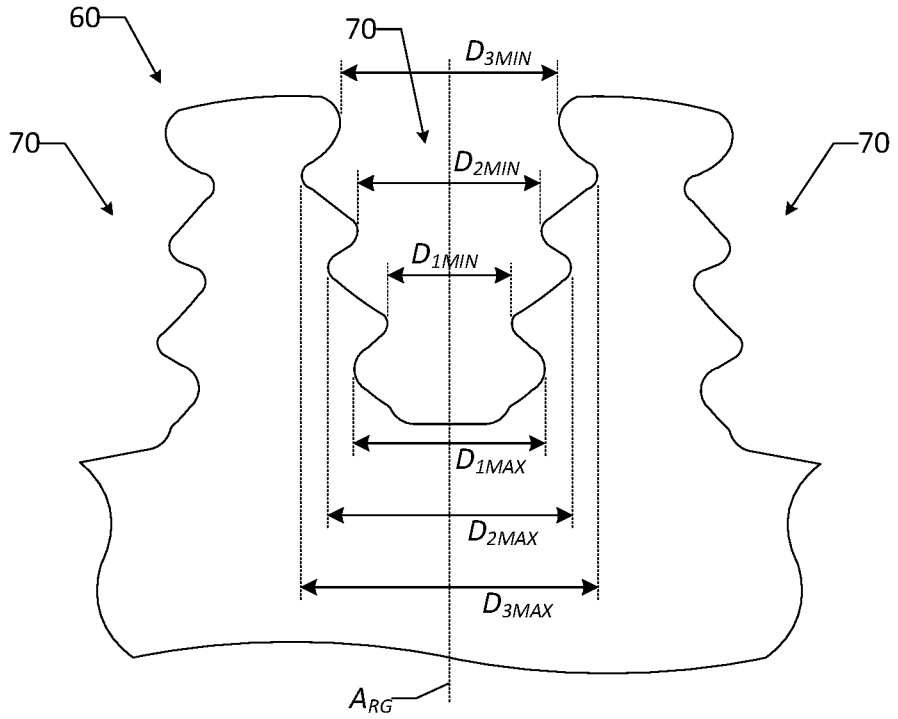
FIG. 1F is a detailed end view of a portion of the rotor disk of FIG. 1B, showing one of the grooves and distances between features of the groove.

As shown in FIG. 1F, the first slots 72*a* may be spaced apart from one another by a first maximum distance $D_{1MAX}$, the second slots 72*b* may be spaced apart from one another by a second maximum distance $D_{2MAX}$, and the third slots 72*c* may be spaced apart from one another by a third maximum distance $D_{3MAX}$, in a direction perpendicular to the longitudinal axis $A_{LG}$ and the radial axis $A_{RG}$ of the groove 70. In some embodiments, as shown, the first maximum distance $D_{1MAX}$ may be less than the second maximum distance $D_{2MAX}$, and the second maximum distance $D_{2MAX}$ may be less than the third maximum distance $D_{3MAX}$. The first ribs 74*a* may be spaced apart from one another by a first minimum distance $D_{1MIN}$, the second ribs 74*b* may be spaced apart from one another by a second minimum distance $D_{2MIN}$, and the third ribs 74*c* may be spaced apart from one another by a third minimum distance $D_{3MIN}$, in the direction perpendicular to the longitudinal axis $A_{LG}$ and the radial axis $A_{RG}$ of the groove 70. In some embodiments, as shown, the first minimum distance $D_{1MIN}$ may be less than the second minimum distance $D_{2MIN}$, and the second minimum distance $D_{2MIN}$ may be less than the third minimum distance $D_{3MIN}$. Further, the first minimum distance $D_{1MIN}$ may be less than the first maximum distance $D_{1MAX}$, the second minimum distance $D_{2MIN}$ may be less than the second maximum distance $D_{2MAX}$, and the third minimum distance $D_{3MIN}$ may be less than the third maximum distance $D_{3MAX}$.

Each groove 70 of the rotor disk 60 may include a radially inner surface 84 extending along the radially inner end 80 of the groove 70 from the upstream end 76 to the downstream end 78 thereof. In some embodiments, the radially inner surface 84 may be a planar surface. In other embodiments, the radially inner surface 84 may be a curved surface. Each groove 70 also may include a number of circumferentially outer surfaces 86 corresponding to the number of slots 72 of the groove 70 and extending from the upstream end 76 to the downstream end 78. In particular, each groove 70 may include a pair of first circumferentially outer surfaces 86*a*, a pair of second circumferentially outer surfaces 86*b*, and a pair of third circumferentially outer surfaces 86*c*, as shown. In some embodiments, each of the circumferentially outer surfaces 86 may be a curved surface. In other embodiments, each of the circumferentially outer surfaces 86 may be a planar surface. Each groove 70 further may include a number of circumferentially inner surfaces 88 corresponding to the number of ribs 74 of the groove 70 and extending from the upstream end 76 to the downstream end 78. In particular, each groove 70 may include a pair of first circumferentially inner surfaces 88*a*, a pair of second circumferentially inner surfaces 88*b*, and a pair of third circumferentially inner surfaces 88*c*, as shown. In some embodiments, each of the circumferentially inner surfaces 88 may be a curved surface. In other embodiments, each of the circumferentially inner surfaces 88 may be a planar surface.

As shown, each groove 70 of the rotor disk 60 also may include a number of radially-outward-facing surfaces 90 corresponding to the number of slots 72 and the number of ribs 74 of the groove 70 and extending from the upstream end 76 to the downstream end 78 thereof. In particular, each groove 70 may include a pair of first radially-outward-facing surfaces 90*a*, a pair of second radially-outward-facing surfaces 90*b*, and a pair of third radially-outward-facing surfaces 90*c*, as shown. In some embodiments, each of the radially-outward-facing surfaces 90 may be a planar surface. In other embodiments, each of the radially-outward-facing surfaces 90 may be a curved surface. Each groove 70 further may include a number of radially-inward-facing surfaces 92 corresponding to the number of slots 72 and the number of ribs 74 of the groove 70 and extending from the upstream end 76 to the downstream end 78. In particular, each groove 70 may include a pair of first radially-inward-facing surfaces 92*a*, a pair of second radially-inward-facing surfaces 92*b*, and a pair of third radially-inward-facing surfaces 92*c*, as shown. In some embodiments, each of the radially-inward-facing surfaces 92 may be a planar surface. In other embodiments, each of the radially-inward-facing surfaces 92 may be a curved surface.

During operation of the turbine 40, the rotor disk 60 and the rotor shaft 62 may rotate about the longitudinal axis $A_{LT}$ of the turbine 40, along with the number of turbine blades supported by the rotor disk 60. The dovetail connections by which the root portions of the turbine blades are received within the respective grooves 70 of the rotor disk 60 may radially retain the root portions within the grooves 70 during rotation. Although the rotor disk 60 may be described above as being used as a part of the turbine 40 of the gas turbine engine 10, it will be understood that the rotor disk 60 also may be used in a similar manner as a part of a turbine of a steam turbine engine.

Figure 2A:
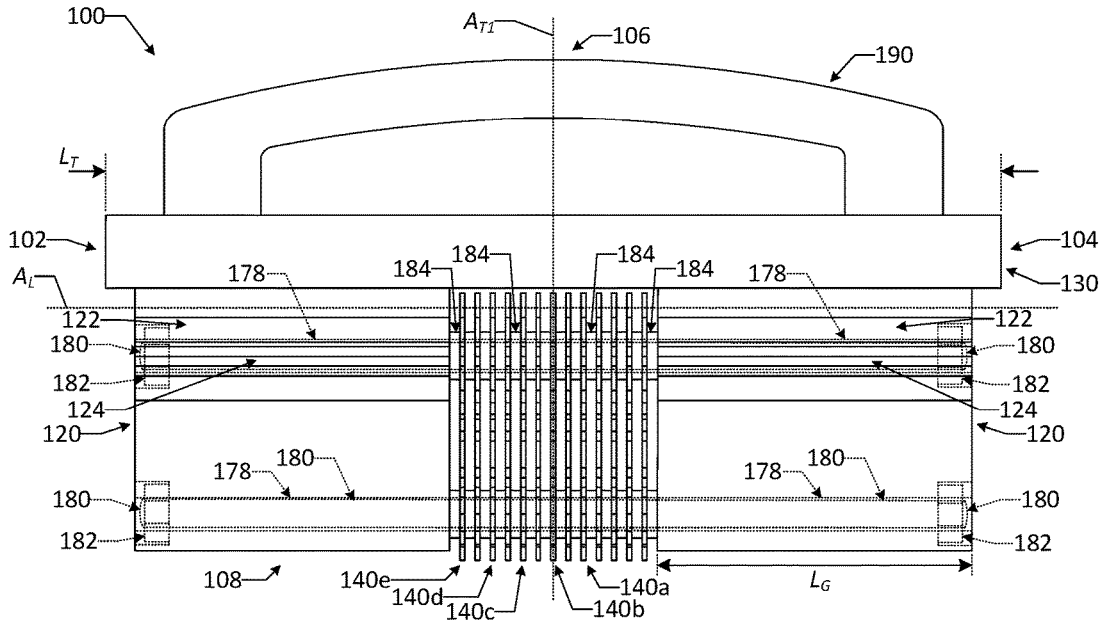
FIG. 2A is a side view of an embodiment of a first tool for cleaning grooves of a rotor disk as may be described herein, the first tool including a pair of guides, a guide mount, a number of cleaning sheets, and a handle.
Figure 2B:
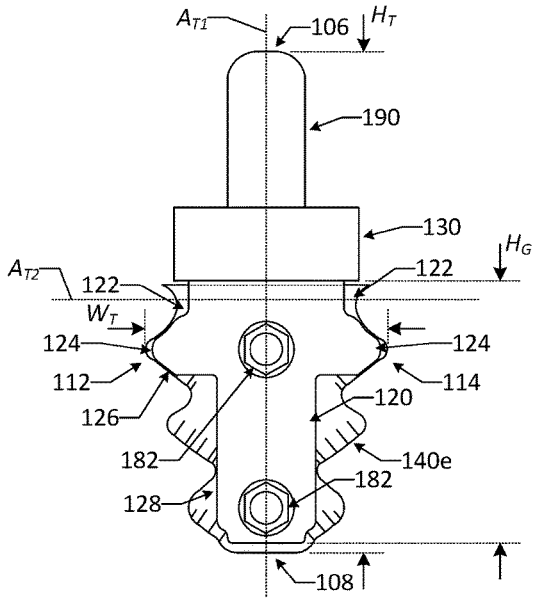
FIG. 2B is an end view of the first tool of FIG. 2A.
Figure 2C:
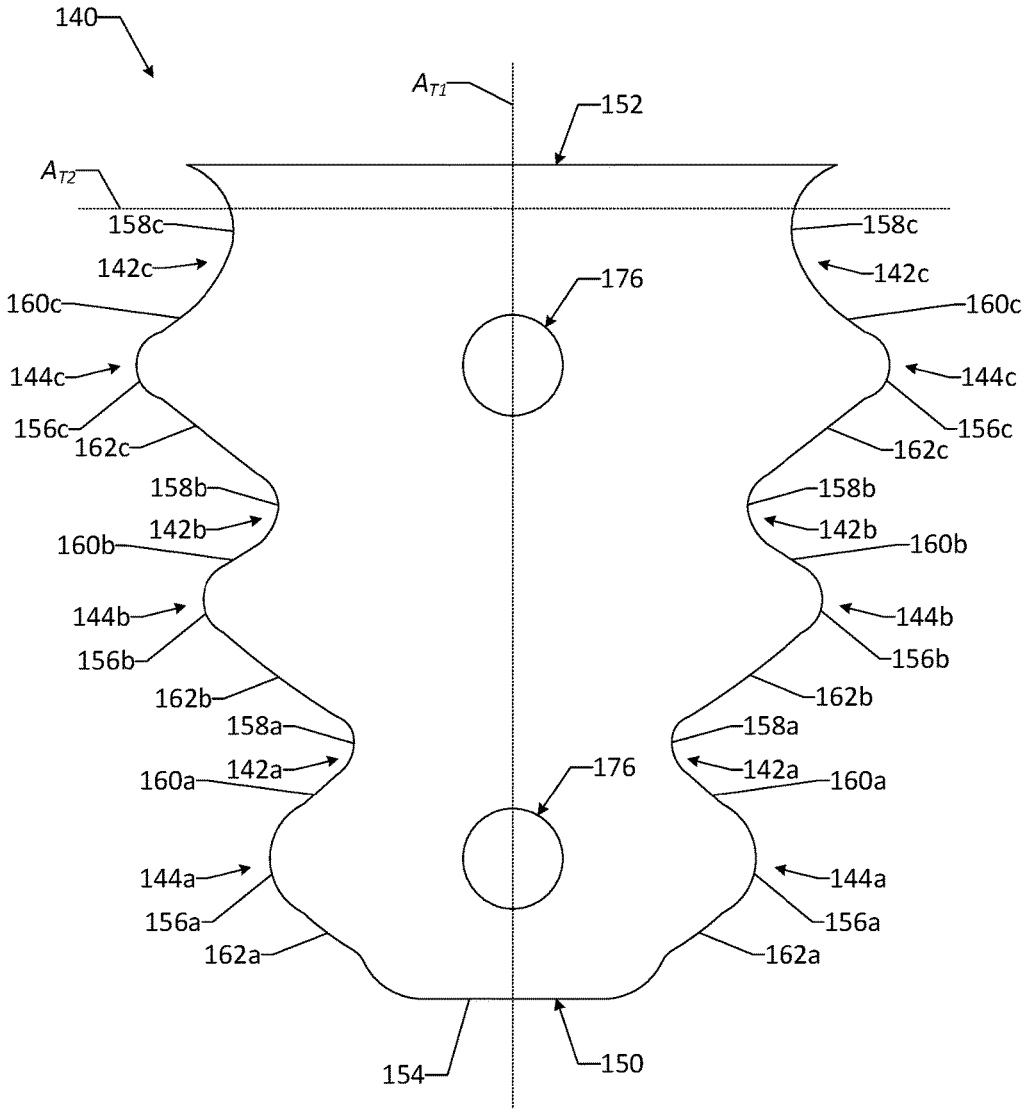
FIG. 2C is a detailed end view of a representative cleaning sheet of the first tool of FIG. 2A, showing a number of recesses, a number of shoulders, and various surfaces of the cleaning sheet.

FIGS. 2A-2R show an embodiment of a first tool 100 (which also may be referred to as a "cleaning tool") as may be described herein. The first tool 100 may be used for cleaning grooves of a rotor disk, such as the grooves 70 of the rotor disk 60 described above. In particular, the first tool 100 may be used for removing hardened dirt, oxidation residue, and/or other contaminants that may accumulate along the various surfaces of the grooves 70 of the rotor disk 60. As shown, the first tool 100 may have a generally elongated shape, with a longitudinal axis $A_L$ extending along a length $L_T$ of the tool 100, a first transverse axis $A_{T1}$ extending long a height $H_T$ of the tool 100, and a second transverse axis $A_{T2}$ extending long a width $W_T$ of the tool 100. In this manner, the first tool 100 may have a first end 102 and a second end 104 positioned opposite one another along the longitudinal axis $A_L$ of the tool 100, a top side 106 and a bottom side 108 positioned opposite one another along the first transverse axis $A_{T1}$ of the tool 100, and a first lateral side 112 and a second lateral side 114 positioned opposite one another along the second transverse axis $A_{T2}$ of the tool 100.

As shown, the first tool 100 may include a pair of guides 120 spaced apart from one another in the direction of the longitudinal axis $A_L$ of the tool 100. The guides 120 may be configured to guide the first tool 100 into and through the grooves 70 of the rotor disk 60, one groove 70 at a time, as described in detail below. Each of the guides 120 may have an elongated shape, with a length $L_G$ in the direction of the longitudinal axis $A_L$ of the tool 100, a height $H_G$ in the direction of the first transverse axis $A_{T1}$ of the tool 100, and a width $W_G$ in the direction of the second transverse axis $A_{T2}$ of the tool 100. As shown, at least a portion of each of the guides 120 may be shaped to have a cross-sectional profile, taken perpendicular to the longitudinal axis $A_L$ of the tool 100 (i.e., viewed from one of the ends 102, 104 of the tool 100), which corresponds to the cross-sectional profile of the groove 70 of the rotor disk 60. In particular, each guide 120 may include a number of slots 122 corresponding to a number of the ribs 74 of the groove 70, and a number of ribs 124 corresponding to a number of the slots 72 of the groove 70. The cross-sectional profile of the slots 122 of the guide 120 may be slightly greater than the cross-sectional profile of the ribs 74 of the groove 70, such that the ribs 74 may be movably received within the slots 122 without jamming. In a similar manner, the cross-sectional profile of the ribs 124 of the guide 120 may be slightly less than the cross-sectional profile of the slots 72 of the groove 70, such that the ribs 124 may be movably received within the slots 72 without jamming.

In some embodiments, as shown, each guide 120 may include a pair of slots 122 positioned opposite one another in a direction of the second transverse axis $A_{T2}$ of the tool 100, and a pair of ribs 124 positioned opposite one another in the direction of the second transverse axis $A_{T2}$. In some embodiments, the slots 122 may be configured to receive the third ribs 74*c* of the groove 70, respectively, and the ribs 124 may be configured to be received within the third slots 72*c* of the groove 70, respectively. In other embodiments, the slots 122 may be configured to receive the first ribs 74*a* or the second ribs 74*b* of the groove 70, respectively, and the ribs 124 may be configured to be received within the first slots 72*a* or the second slots 72*b* of the groove 70, respectively. Although each guide 120 is shown as including two (2) slots 122 and two (2) ribs 124 in the illustrated embodiment, each guide 120 may include any number of slots 122 and any number of ribs 124, corresponding to the number of ribs 74 and the number of slots 72 of the groove 70, in other embodiments.

As shown, each guide 120 may include a first portion 126 having a cross-sectional profile, taken perpendicular to the longitudinal axis $A_L$ of the tool 100, which corresponds to the cross-sectional profile of the groove 70 of the rotor disk 60, and a second portion 128 having a cross-sectional profile which does not correspond to the cross-sectional profile of the groove 70. The first portion 126 may include the slots 122 and the ribs 124, and the second portion 128 may be devoid of any slots and ribs, as shown. In some embodiments, as shown, the first portion 126 may be an upper portion (i.e., closer to the top side 106 of the tool 100) of the guide 120, and the second portion 128 may be a lower portion (i.e., closer to the bottom side 108 of the tool 100) of the guide 120. In other embodiments, the first portion 126 may be a lower portion or an intermediate portion of the guide 120, and the second portion 128 may be an upper portion or an intermediate portion of the guide 120.

Each of the guides 120 may be formed of a non-abrasive material that is softer than the material of which the rotor disk 60 is formed. In this manner, the guides 120 may pass through the grooves 70 of the rotor disk 60 and contact one or more surfaces of the grooves 70, without scratching or otherwise harming such surfaces. In some embodiments, the guides 120 may be formed of nylon, although other non-abrasive materials, including suitable plastics, composites, or metals, may be used in other embodiments. In some embodiments, as shown, the guides 120 may have an identical shape and configuration. In other embodiments, one of the guides 120 may have a different shape and/or configuration than the other guide 120.

As shown, the guides 120 may be rigidly attached to a common guide mount 130. The guide mount 130 may be formed as an elongated member spanning the length $L_T$ of the first tool 100. In some embodiments, as shown, the guide mount 130 may be formed as a plate, although other shapes of the guide mount 130 may be used in other embodiments. The guides 120 may be attached, either fixedly or removably, to the guide mount 130 to maintain the guides 120 in their spaced apart relationship in the direction of the longitudinal axis $A_L$ of the tool 100. In some embodiments, the guides 120 may be attached to the guide mount 130 via one or more fasteners, although other suitable attachment mechanisms may be used in other embodiments. The guide mount 130 may be formed of a rigid and durable material. In some embodiments, the guide mount 130 may be formed of a metal, such as stainless steel, although other rigid materials, including suitable plastics or composites, may be used in other embodiments.

The first tool 100 also may include a number of cleaning sheets 140 positioned between the guides 120 and spaced apart from one another in the direction of the longitudinal axis $A_L$ of the tool 100. The cleaning sheets 140 may be configured to pass through the grooves 70 of the rotor disk 60, one groove 70 at a time, and remove contaminants from the various surfaces of the grooves 70, as described in detail below. Each of the cleaning sheets 140 may have a planar, sheet-like shape, with a thickness $T_S$ in the direction of the longitudinal axis $A_L$ of the tool 100, a height $H_S$ in the direction of the first transverse axis $A_{T1}$ of the tool 100, and a width $W_S$ in the direction of the second transverse axis $A_{T2}$ of the tool 100. As shown, at least a portion of each of the cleaning sheets 140 may be shaped to have a cross-sectional profile, taken perpendicular to the longitudinal axis $A_L$ of the tool 100 (i.e., viewed from one of the ends 102, 104 of the tool 100), which corresponds to the cross-sectional profile of the groove 70 of the rotor disk 60. In some embodiments, as shown, each cleaning sheet 140 may have a dovetail shape having a fir-tree configuration, when viewed from one of the ends 102, 104 of the tool 100. In particular, each cleaning sheet 140 may include a number of recesses 142 corresponding to a number of the ribs 74 of the groove 70, and a number of shoulders 144 corresponding to a number of the slots 72 of the groove 70.

In some embodiments, as shown, each cleaning sheet 140 may include a pair of first recesses 142*a* (which also may be referred to as "lower recesses"), a pair of second recesses 142*b* (which also may be referred to as "intermediate recesses"), a pair of third recesses 142*c* (which also may be referred to as "upper recesses"), a pair of first shoulders 144*a* (which also may be referred to as "lower shoulders"), a pair of second shoulders 144*b* (which also may be referred to as "intermediate shoulders"), and a pair of third shoulders 144*c* (which also may be referred to as "upper shoulders"). Although each cleaning sheet 140 is shown as including six (6) recesses 142 and six (6) shoulders 144 in the illustrated embodiment, each cleaning sheet 140 may include any number of recesses 142 and any number of shoulders 144, corresponding to corresponding to the number of ribs 74 and the number of slots 72 of the groove 70, in other embodiments.

As shown, each cleaning sheet 140 may have a first end 146 and a second end 148 positioned opposite one another in the direction of the longitudinal axis $A_L$ of the tool 100, and a bottom end 150 and a top end 152 positioned opposite one another in the direction of the first transverse axis $A_{T1}$ of the tool 100. As shown, the first recesses 142*a* may be positioned opposite one another in the direction of the second transverse axis $A_{T2}$ of the tool 100, the second recesses 142*b* may be positioned opposite one another in the direction of the second transverse axis $A_{T2}$, and the third recesses 142*c* may be positioned opposite one another in the direction of the second transverse axis $A_{T2}$. In a similar manner, the first shoulders 144*a* may be positioned opposite one another in the direction of the second transverse axis $A_{T2}$ of the tool 100, the second shoulders 144*b* may be positioned opposite one another in the direction of the second transverse axis $A_{T2}$, and the third shoulders 144*c* may be positioned opposite one another in the direction of the second transverse axis $A_{T2}$. Each of the recesses 142*a*, 142*b*, 142*c* and each of the shoulders 144*a*, 144*b*, 144*c* may extend from the first end 146 to the second end 148 of the cleaning sheet 140.

Figures 2D, 2E:
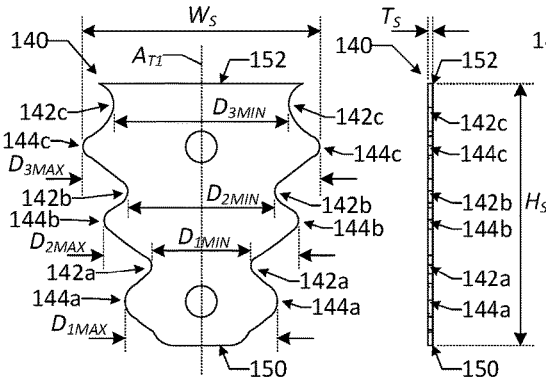
FIG. 2D is an end view of the cleaning sheet of FIG. 2C, showing the recesses, the shoulders, and distances between features of the cleaning sheet.
FIG. 2E is a side view of the cleaning sheet of FIG. 2D.

As shown in FIG. 2D, the first recesses 142*a* may be spaced apart from one another by a first minimum distance $D_{1MIN}$, the second recesses 142*b* may be spaced apart from one another by a second minimum distance $D_{2MIN}$, and the third recesses 142*c* may be spaced apart from one another by a third minimum distance $D_{3MIN}$, in the direction of the second transverse axis $A_{T2}$ of the tool 100. In some embodiments, as shown, the first minimum distance $D_{1MIN}$ may be less than the second minimum distance $D_{2MIN}$, and the second minimum distance $D_{2MIN}$ may be less than the third minimum distance $D_{3MIN}$. The first shoulders 144*a* may be spaced apart from one another by a first maximum distance $D_{1MAX}$, the second shoulders 144*b* may be spaced apart from one another by a second maximum distance $D_{2MAX}$, and the third shoulders 144*c* may be spaced apart from one another by a third maximum distance $D_{3MAX}$, in the direction of the second transverse axis $A_{T2}$. In some embodiments, as shown, the first maximum distance $D_{1MAX}$ may be less than the second maximum distance $D_{2MAX}$, and the second maximum distance $D_{2MAX}$ may be less than the third maximum distance $D_{3MAX}$. Further, the first minimum distance $D_{1MIN}$ may be less than the first maximum distance $D_{1MAX}$, the second minimum distance $D_{2MIN}$ may be less than the second maximum distance $D_{2MAX}$, and the third minimum distance $D_{3MIN}$ may be less than the third maximum distance $D_{3MAX}$.

Each cleaning sheet 140 may include a bottom surface 154 extending along the bottom end 150 of the cleaning sheet 140 from the first end 146 to the second end 148 thereof. In some embodiments, the bottom surface 154 may be a planar surface. In other embodiments, the bottom surface 154 may be a curved surface. Each cleaning sheet 140 also may include a number of laterally-outer surfaces 156 corresponding to the number of shoulders 144 of the cleaning sheet 140 and extending from the first end 146 to the second end 148. In particular, each cleaning sheet 140 may include a pair of first laterally-outer surfaces 156*a*, a pair of second laterally-outer surfaces 156*b*, and a pair of third laterally-outer surfaces 156*c*, as shown. In some embodiments, each of the laterally-outer surfaces 156 may be a curved surface. In other embodiments, each of the laterally-outer surfaces 156 may be a planar surface. Each cleaning sheet 140 further may include a number of laterally-inner surfaces 158 corresponding to the number of recesses 142 of the cleaning sheet 140 and extending from the first end 146 to the second end 148. In particular, each cleaning sheet 140 may include a pair of first laterally-inner surfaces 158*a*, a pair of second laterally-inner surfaces 158*b*, and a pair of third laterally-inner surfaces 158*c*, as shown. In some embodiments, each of the laterally-inner surfaces 158 may be a curved surface. In other embodiments, each of the laterally-inner surfaces 158 may be a planar surface.

As shown, each cleaning sheet 140 also may include a number of top-facing surfaces 160 corresponding to the number of recesses 142 and the number of shoulders 144 of the cleaning sheet 140 and extending from the first end 146 to the second end 148 thereof. In particular, each cleaning sheet may include a pair of first top-facing surfaces 160*a*, a pair of second top-facing surfaces 160*b*, and a pair of third top-facing surfaces 160*c*, as shown. In some embodiments, each of the top-facing surfaces 160 may be a planar surface. In other embodiments, each of the top-facing surfaces 160 may be a curved surface. Each cleaning sheet 140 further may include a number of bottom-facing surfaces 162 corresponding to the number of recesses 142 and the number of shoulders 144 of the cleaning sheet 140 and extending from the first end 146 to the second end 148. In particular, each cleaning sheet 140 may include a pair of first bottom-facing surfaces 162*a*, a pair of second bottom-facing surfaces 162*b*, and a pair of third bottom-facing surfaces 162*c*, as shown. In some embodiments, each of the bottom-facing surfaces 162 may be a planar surface. In other embodiments, each of the bottom-facing surfaces 162 may be a curved surface.

As described above, the cleaning sheets 140 of the first tool 100 may be configured to pass through the grooves 70 of the rotor disk 60, one groove 70 at a time, and remove contaminants from the surfaces of the groove 70. The number of cleaning sheets 140 may include two or more cleaning sheets 140 having different sizes, shapes, and/or configurations. In this manner, each of the different cleaning sheets 140 may be configured to contact one or more surfaces of the groove 70 and to not contact (i.e., to remain spaced apart from) remaining surfaces of the groove 70 as the cleaning sheets 140 pass through the groove 70, while the cleaning sheets 140 collectively contact all of the surfaces of the groove 70 and remove contaminants therefrom. In particular, each of the different cleaning sheets 140 may include one or more contact portions 164 configured to contact one or more surfaces of the groove 70, and one or more non-contact portions 166 configured to not contact (i.e., to remain spaced apart from) the remaining surfaces of the groove 70. In some embodiments, as shown, the first tool 100 may include five (5) different cleaning sheets 140 each having a different size, shape, and/or configuration for contacting and cleaning different surfaces of the groove 70. In particular, the first tool 100 may include a first cleaning sheet 140*a*, a second cleaning sheet 140*b*, a third cleaning sheet 140*c*, a fourth cleaning sheet 140*d*, and a fifth cleaning sheet 140*e* each having different contact portions 164, as described below. In other embodiments, the first tool 100 may include two (2), three (3), four (4), six (6), seven (7), eight (8), nine (9), ten (10), or more different cleaning sheets 140 each having different contact portions 164 configured for contacting and cleaning different surfaces of the groove 70.

Figures 2F, 2G:
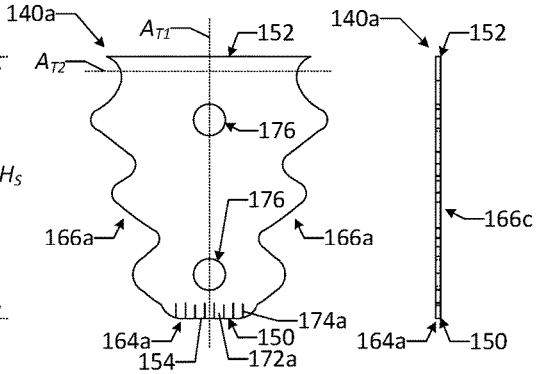
FIG. 2F is an end view of a first cleaning sheet of the first tool of FIG. 2A.
FIG. 2G is a side view of the first cleaning sheet of FIG. 2F.

FIGS. 2F and 2G show the first cleaning sheet 140*a* (which also may be referred to as a "radially-inner-surface cleaning sheet") as may be described herein. The first cleaning sheet 140*a* generally may be shaped in the manner described above with the respect to the representative cleaning sheet 140, but may include one or more contact portions 164*a* unique to the first cleaning sheet 140*a*. In particular, the first cleaning sheet 140*a* may include a contact portion 164*a* positioned along the bottom end 150 of the cleaning sheet 140*a* and including the bottom surface 154 thereof, as shown. In this manner, the contact portion 164*a* may be configured to contact and clean the radially inner surface 84 of the groove 70 as the first tool 100 passes through the groove 70. The contact portion 164*a* may be formed by the bottom end 150 portion of the first cleaning sheet 140*a* having a cross-sectional area, taken perpendicular to the longitudinal axis $A_L$ of the tool 100, which is greater than the cross-sectional area of each of the bottom end 150 portions of the other cleaning sheets 140*b*, 140*c*, 140*d*, 140*e*. For example, the bottom surface 154 of the first cleaning sheet 140*a* may be positioned further away from the second transverse axis $A_{T2}$ of the tool 100, in the direction of the first transverse axis $A_{T1}$, than each of the bottom surfaces 154 of the other cleaning sheets 140*b*, 140*c*, 140*d*, 140*e*.

The contact portion 164*a* may be sized and configured to interfere with the bottom surface 84 of the groove 70 as the first tool 100 passes through the groove 70. To accommodate such interference, the contact portion 164*a* may include a number of fingers 172*a* (which also may be referred to as "spring fingers") positioned along the bottom surface 154, with each adjacent pair of the fingers 172*a* being separated by a slot 174*a* extending through the first cleaning sheet 140*a* from the first end 146 to the second end 148 thereof. In some embodiments, as shown, the fingers 172*a* and the slots 174*a* may extend perpendicular to or substantially perpendicular to the bottom surface 154, although other orientations may be used in other embodiments. In this manner, as the contact portion 164*a* passes through the groove 70 and interferes with the bottom surface 84 thereof, the fingers 172*a* may be resiliently deflected at least partially away from their natural position (i.e., deflected in the direction of the longitudinal axis $A_L$ of the tool 100, opposite the direction of travel of the tool 100) while maintaining contact with the bottom surface 84. The force imparted by the contact portion 164*a* on the bottom surface 84 of the groove 70 may be sufficient to remove contaminants from the bottom surface 84 as the first tool 100 passes through the groove 70.

The first cleaning sheet 140*a* also may include two (2) non-contact portions 166*a* configured to not contact the remaining surfaces of the groove 70. As shown, the non-contact portions 166*a* may include the laterally-outer surfaces 156*a*, 156*b*, 156*c*, the laterally-inner surfaces 158*a*, 158*b*, 158*c*, the top-facing surfaces 160*a*, 160*b*, 160*c*, and the bottom-facing surfaces 162*a*, 162*b*, 162*c* of the first cleaning sheet 140*a*. The non-contact portions 166*a* may be devoid of fingers and slots, as shown.

Figures 2H, 2I:
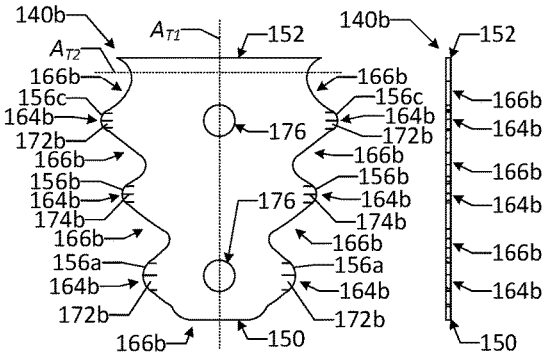
FIG. 2H is an end view of a second cleaning sheet of the first tool of FIG. 2A.
FIG. 2I is a side view of the second cleaning sheet of FIG. 2H.

FIGS. 2H and 2I show the second cleaning sheet 140*b* (which also may be referred to as a "circumferentially-outer-surface cleaning sheet") as may be described herein. The second cleaning sheet 140*b* generally may be shaped in the manner described above with the respect to the representative cleaning sheet 140, but may include one or more contact portions 164*b* unique to the second cleaning sheet 140*b*. In particular, the second cleaning sheet 140*b* may include six (6) contact portions 164*b* positioned, respectively, along the shoulders 144*a*, 144*b*, 144*c* of the cleaning sheet 140*b* and including the laterally-outer surfaces 156*a*, 156*b*, 156*c* thereof, as shown. In this manner, the contact portions 164*b* may be configured to contact and clean the respective circumferentially-outer surfaces 86*a*, 86*b*, 86*c* of the groove 70 as the first tool 100 passes through the groove 70. The contact portions 164*b* may be formed by each of the shoulders 144*a*, 144*b*, 144*c* of the second cleaning sheet 140*b* having a cross-sectional area, taken perpendicular to the longitudinal axis $A_L$ of the tool 100, which is greater than the cross-sectional area of each of the respective shoulders 144*a*, 144*b*, 144*c* of the other cleaning sheets 140*a*, 140*c*, 140*d*, 140*e*. For example, each of the laterally-outer surfaces 156*a*, 156*b*, 156*c* of the second cleaning sheet 140*b* may be positioned further away from the first transverse axis $A_{T1}$ of the tool 100, in the direction of the second transverse axis $A_{T2}$, than each of the respective laterally-outer surfaces 156*a*, 156*b*, 156*c* of the other cleaning sheets 140*a*, 140*c*, 140*d*, 140*e*.

The contact portions 164*b* may be sized and configured to interfere with the respective circumferentially-outer surfaces 86*a*, 86*b*, 86*c* of the groove 70 as the first tool 100 passes through the groove 70. To accommodate such interference, each of the contact portions 164*b* may include a number of fingers 172*b* positioned along the respective laterally-outer surfaces 156*a*, 156*b*, 156*c*, with each adjacent pair of the fingers 172*b* being separated by a slot 174*b* extending through the second cleaning sheet 140*b* from the first end 146 to the second end 148 thereof. In some embodiments, as shown, the fingers 172*b* and the slots 174*b* may extend parallel to or substantially parallel to the second transverse axis $A_{T2}$ of the tool 100, although other orientations may be used in other embodiments. In this manner, as the contact portions 164*b* pass through the groove 70 and interfere with the respective circumferentially-outer surfaces 86*a*, 86*b*, 86*c* thereof, the fingers 172*b* may be resiliently deflected at least partially away from their natural position while maintaining contact with the respective circumferentially-outer surfaces 86*a*, 86*b*, 86*c*. The force imparted by the contact portions 164*b* on the respective circumferentially-outer surfaces 86*a*, 86*b*, 86*c* of the groove 70 may be sufficient to remove contaminants from the circumferentially-outer surfaces 86*a*, 86*b*, 86*c* as the first tool 100 passes through the groove 70.

The second cleaning sheet 140*b* also may include seven (7) non-contact portions 166*b* configured to not contact the remaining surfaces of the groove 70. As shown, the non-contact portions 166*b* may include the bottom surface 154, the laterally-inner surfaces 158*a*, 158*b*, 158*c*, the top-facing surfaces 160*a*, 160*b*, 160*c*, and the bottom-facing surfaces 162*a*, 162*b*, 162*c* of the second cleaning sheet 140*b*. The non-contact portions 166*b* may be devoid of fingers and slots, as shown.

Figures 2J, 2K:
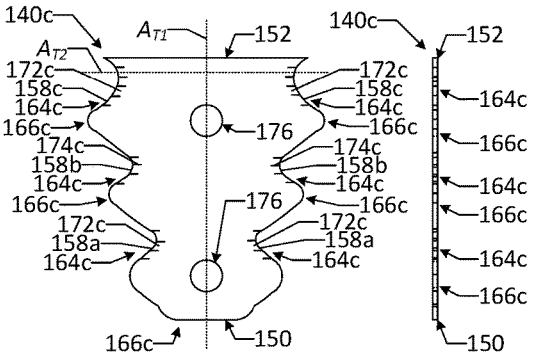
FIG. 2J is an end view of a third cleaning sheet of the first tool of FIG. 2A.
FIG. 2K is a side view of the third cleaning sheet of FIG. 2L.

FIGS. 2J and 2K show the third cleaning sheet 140*c* (which also may be referred to as a "circumferentially-inner-surface cleaning sheet") as may be described herein. The third cleaning sheet 140*c* generally may be shaped in the manner described above with the respect to the representative cleaning sheet 140, but may include one or more contact portions 164*c* unique to the third cleaning sheet 140*c*. In particular, the third cleaning sheet 140*c* may include six (6) contact portions 164*c* positioned, respectively, along the recesses 142*a*, 142*b*, 142*c* of the cleaning sheet 140*c* and including the laterally-inner surfaces 158*a*, 158*b*, 158*c* thereof, as shown. In this manner, the contact portions 164*c* may be configured to contact and clean the respective circumferentially-inner surfaces 88*a*, 88*b*, 88*c* of the groove 70 as the first tool 100 passes through the groove 70. The contact portions 164*c* may be formed by each of the recesses 142*a*, 142*b*, 142*c* of the third cleaning sheet 140*c* having a cross-sectional area, taken perpendicular to the longitudinal axis $A_L$ of the tool 100, which is less than the cross-sectional area of each of the respective recesses 142*a*, 142*b*, 142*c* of the other cleaning sheets 140*a*, 140*b*, 140*d*, 140*e*. For example, each of the laterally-inner surfaces 158*a*, 158*b*, 158*c* of the third cleaning sheet 140*c* may be positioned further away from the first transverse axis $A_{T1}$ of the tool 100, in the direction of the second transverse axis $A_{T2}$, than each of the respective laterally-inner surfaces 158*a*, 158*b*, 158*c* of the other cleaning sheets 140*a*, 140*b*, 140*d*, 140*e*.

The contact portions 164*c* may be sized and configured to interfere with the respective circumferentially-inner surfaces 88*a*, 88*b*, 88*c* of the groove 70 as the first tool 100 passes through the groove 70. To accommodate such interference, each of the contact portions 164*c* may include a number of fingers 172*c* positioned along the respective laterally-inner surfaces 158*a*, 158*b*, 158*c*, with each adjacent pair of the fingers 172*c* being separated by a slot 174*c* extending through the third cleaning sheet 140*c* from the first end 146 to the second end 148 thereof. In some embodiments, as shown, the fingers 172*c* and the slots 174*c* may extend parallel to or substantially parallel to the second transverse axis $A_{T2}$ of the tool 100, although other orientations may be used in other embodiments. In this manner, as the contact portions 164*c* pass through the groove 70 and interfere with the respective circumferentially-inner surfaces 88*a*, 88*b*, 88*c* thereof, the fingers 172*c* may be resiliently deflected at least partially away from their natural position while maintaining contact with the respective circumferentially-inner surfaces 88*a*, 88*b*, 88*c*. The force imparted by the contact portions 164*c* on the respective circumferentially-inner surfaces 88*a*, 88*b*, 88*c* of the groove 70 may be sufficient to remove contaminants from the circumferentially-inner surfaces 88*a*, 88*b*, 88*c* as the first tool 100 passes through the groove 70.

The third cleaning sheet 140*c* also may include five (5) non-contact portions 166*c* configured to not contact the remaining surfaces of the groove 70. As shown, the non-contact portions 166*c* may include the bottom surface 154, the laterally-outer surfaces 156*a*, 156*b*, 156*c*, the top-facing surfaces 160*a*, 160*b*, 160*c*, and the bottom-facing surfaces 162*a*, 162*b*, 162*c* of the second cleaning sheet 140*b*. The non-contact portions 166*c* may be devoid of fingers and slots, as shown.

Figures 2L, 2M:
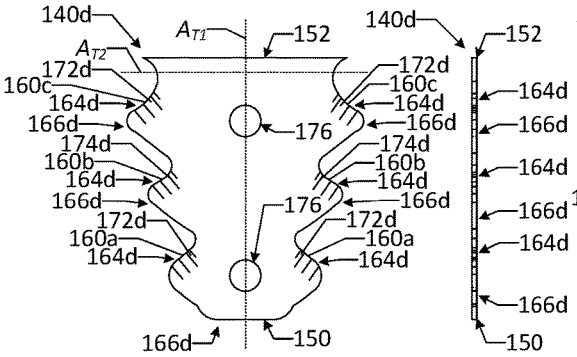
FIG. 2L is an end view of a fourth cleaning sheet of the first tool of FIG. 2A.
FIG. 2M is a side view of the fourth cleaning sheet of FIG. 2L.

FIGS. 2L and 2M show the fourth cleaning sheet 140*d* (which also may be referred to as a "radially-inward-facing-surface cleaning sheet") as may be described herein. The fourth cleaning sheet 140*d* generally may be shaped in the manner described above with the respect to the representative cleaning sheet 140, but may include one or more contact portions 164*d* unique to the fourth cleaning sheet 140*d*. In particular, the fourth cleaning sheet 140*d* may include six (6) contact portions 164*d* positioned, respectively, along top portions of the shoulders 144*a*, 144*b*, 144*c* and bottom portions of the recesses 142*a*, 142*b*, 142*c* of the cleaning sheet 140*d* and including the top-facing surfaces 160*a*, 160*b*, 160*c* thereof, as shown. In this manner, the contact portions 164*d* may be configured to contact and clean the respective radially-inward-facing surfaces 92*a*, 92*b*, 92*c* of the groove 70 as the first tool 100 passes through the groove 70. The contact portions 164*d* may be formed by each of the top portions of the shoulders 144*a*, 144*b*, 144*c* of the fourth cleaning sheet 140*d* having a cross-sectional area, taken perpendicular to the longitudinal axis $A_L$ of the tool 100, which is greater than the cross-sectional area of each of the top portions of the respective shoulders 144*a*, 144*b*, 144*c* of the other cleaning sheets 140*a*, 140*b*, 140*c*, 140*e*. For example, each of the top-facing surfaces 160*a*, 160*b*, 160*c* of the fourth cleaning sheet 140*d* may be positioned further away from the first transverse axis $A_{T1}$ of the tool 100, in the direction of the second transverse axis $A_{T2}$, and closer to the second transverse axis $A_{T2}$ of the tool 100, in the direction of the first transverse axis $A_{T1}$, than each of the respective top-facing surfaces 160*a*, 160*b*, 160*c* of the other cleaning sheets 140*a*, 140*b*, 140*c*, 140*e*.

The contact portions 164*d* may be sized and configured to interfere with the respective radially-inward-facing surfaces 92*a*, 92*b*, 92*c* of the groove 70 as the first tool 100 passes through the groove 70. To accommodate such interference, each of the contact portions 164*d* may include a number of fingers 172*d* positioned along the respective top-facing surfaces 160*a*, 160*b*, 160*c*, with each adjacent pair of the fingers 172*d* being separated by a slot 174*d* extending through the fourth cleaning sheet 140*d* from the first end 146 to the second end 148 thereof. In some embodiments, as shown, the fingers 172*d* and the slots 174*d* may extend perpendicular to or substantially perpendicular to the respective top-facing surfaces 160*a*, 160*b*, 160*c*, although other orientations may be used in other embodiments. In this manner, as the contact portions 164*d* pass through the groove 70 and interfere with the respective radially-inward-facing surfaces 92*a*, 92*b*, 92*c* thereof, the fingers 172*d* may be resiliently deflected at least partially away from their natural position while maintaining contact with the respective radially-inward-facing surfaces 92*a*, 92*b*, 92*c*. The force imparted by the contact portions 164*d* on the respective radially-inward-facing surfaces 92*a*, 92*b*, 92*c* of the groove 70 may be sufficient to remove contaminants from the radially-inward-facing surfaces 92*a*, 92*b*, 92*c* as the first tool 100 passes through the groove 70.

The fourth cleaning sheet 140*d* also may include seven (7) non-contact portions 166*d* configured to not contact the remaining surfaces of the groove 70. As shown, the non-contact portions 166*d* may include the bottom surface 154, at least a portion of each of the laterally-outer surfaces 156*a*, 156*b*, 156*c*, at least a portion of each of the laterally-inner surfaces 158*a*, 158*b*, 158*c*, and the bottom-facing surfaces 162*a*, 162*b*, 162*c* of the fourth cleaning sheet 140*b*. The non-contact portions 166*b* may be devoid of fingers and slots, as shown.

Figures 2N, 2O:
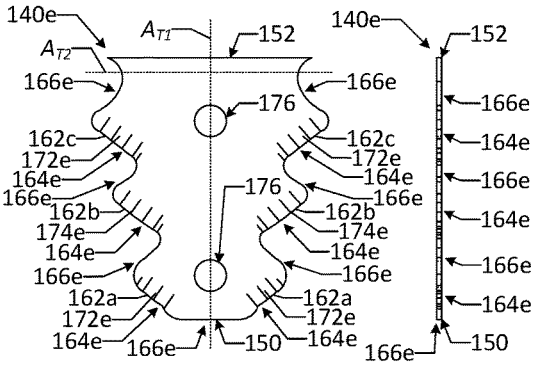
FIG. 2N is an end view of a fifth cleaning sheet of the first tool of FIG. 2A.
FIG. 2O is a side view of the fifth cleaning sheet of FIG. 2N.

FIGS. 2N and 2O show the fifth cleaning sheet 140*e* (which also may be referred to as a "radially-outward-facing-surface cleaning sheet") as may be described herein. The fifth cleaning sheet 140*e* generally may be shaped in the manner described above with the respect to the representative cleaning sheet 140, but may include one or more contact portions 164*e* unique to the fifth cleaning sheet 140*e*. In particular, the fifth cleaning sheet 140*e* may include six (6) contact portions 164*e* positioned, respectively, along bottom portions of the shoulders 144*a*, 144*b*, 144*c* and top portions of the recesses 142*a*, 142*b* of the cleaning sheet 140*e* and including the bottom-facing surfaces 162*a*, 162*b*, 162*c* thereof, as shown. In this manner, the contact portions 164*e* may be configured to contact and clean the respective radially-outward-facing surfaces 90*a*, 90*b*, 90*c* of the groove 70 as the first tool 100 passes through the groove 70. The contact portions 164*e* may be formed by each of the bottom portions of the shoulders 144*a*, 144*b*, 144*c* of the fifth cleaning sheet 140*e* having a cross-sectional area, taken perpendicular to the longitudinal axis $A_L$ of the tool 100, which is greater than the cross-sectional area of each of the bottom portions of the respective shoulders 144*a*, 144*b*, 144*c* of the other cleaning sheets 140*a*, 140*b*, 140*c*, 140*d*. For example, each of the bottom-facing surfaces 162*a*, 162*b*, 162*c* of the fifth cleaning sheet 140*e* may be positioned further away from the first transverse axis $A_{T1}$ of the tool 100, in the direction of the second transverse axis $A_{T2}$, and further away from the second transverse axis $A_{T2}$ of the tool 100, in the direction of the first transverse axis $A_{T1}$, than each of the respective bottom-facing surfaces 162*a*, 162*b*, 162*c* of the other cleaning sheets 140*a*, 140*b*, 140*c*, 140*d*.

The contact portions 164*e* may be sized and configured to interfere with the respective radially-outward-facing surfaces 90*a*, 90*b*, 90*c* of the groove 70 as the first tool 100 passes through the groove 70. To accommodate such interference, each of the contact portions 164*e* may include a number of fingers 172*e* positioned along the respective bottom-facing surfaces 162*a*, 162*b*, 162*c*, with each adjacent pair of the fingers 172*e* being separated by a slot 174*e* extending through the fifth cleaning sheet 140*e* from the first end 146 to the second end 148 thereof. In some embodiments, as shown, the fingers 172*e* and the slots 174*e* may extend perpendicular to or substantially perpendicular to the respective bottom-facing surfaces 162*a*, 162*b*, 162*c*, although other orientations may be used in other embodiments. In this manner, as the contact portions 164*e* pass through the groove 70 and interfere with the respective radially-outward-facing surfaces 90*a*, 90*b*, 90*c* thereof, the fingers 172*e* may be resiliently deflected at least partially away from their natural position while maintaining contact with the respective radially-outward-facing surfaces 90*a*, 90*b*, 90*c*. The force imparted by the contact portions 164*e* on the respective radially-outward-facing surfaces 90*a*, 90*b*, 90*c* of the groove 70 may be sufficient to remove contaminants from the radially-outward-facing surfaces 90*a*, 90*b*, 90*c* as the first tool 100 passes through the groove 70.

The fifth cleaning sheet 140*e* also may include seven (7) non-contact portions 166*e* configured to not contact the remaining surfaces of the groove 70. As shown, the non-contact portions 166*e* may include the bottom surface 154, at least a portion of each of the laterally-outer surfaces 156*a*, 156*b*, 156*c*, at least a portion of each of the laterally-inner surfaces 158*a*, 158*b*, 158*c*, and the top-facing surfaces 160*a*, 160*b*, 160*c* of the fourth cleaning sheet 140*b*. The non-contact portions 166*e* may be devoid of fingers and slots, as shown.

As shown, each cleaning sheet 140 may include one or more mounting holes 176 extending therethrough from the first end 146 to the second end 148 thereof to facilitate mounting of the cleaning sheets 140 relative to the guides 120. The mounting holes 176 of the cleaning sheets 140 may be aligned with respective mounting holes 178 of the guides 120, and respective rods 180 may extend therethrough. At least the end portions of the rods 180 may be threaded and configured to engage respective nuts 182 thereon to retain the rods 180 within the mounting holes 176, 178. The nuts 182 and the end portions of the rods 180 may be positioned within countersunk bores defined in the guides 120, as shown, such that the nuts 182 and the end portions of the rods 180 do not extend outwardly beyond the guides 120. In this manner, the nuts 182 and the end portions of the rods 180 may be prevented from contacting and damaging the rotor disk 60 during use of the first tool 100. As shown, respective spacers 184 may be positioned over the rods 180 between each adjacent pair of cleaning sheets 140 and between each guide 120 and the cleaning sheets 140. In this manner, the spaced apart relationship of the cleaning sheets 140 in the direction of the longitudinal axis $A_L$ of the tool 100 may be maintained by the spacers 184. In some embodiments, as shown in FIG. 2P, each spacer 184 may be formed as an elongated member having a "dog bone" shape and a pair of spacer holes 186 spaced apart from one another and configured to receive the respective rods 180 therethough. The cleaning sheets 140 may be formed of a flexible and durable material. In some embodiments, the cleaning sheets 140 may be formed of a metal, such as stainless spring steel, although other suitable flexible materials may be used in other embodiments.

Although the illustrated embodiment shows the first tool 100 as including thirteen (13) cleaning sheets 140, any number of the cleaning sheets 140 may be used in other embodiments. In some embodiments, as shown, the number of cleaning sheets 140 may include one or more of the first cleaning sheets 140*a*, one or more of the second cleaning sheets 140*b*, one or more of the third cleaning sheets 140*c*, one or more of the fourth cleaning sheets 140*d*, and one or more of the fifth cleaning sheets 140*e*. In some embodiments, as shown, the number of cleaning sheets 140 may include two or more of the first cleaning sheets 140*a*, two or more of the second cleaning sheets 140*b*, two or more of the third cleaning sheets 140*c*, two or more of the fourth cleaning sheets 140*d*, and two or more of the fifth cleaning sheets 140*e*. The different cleaning sheets 140*a*, 140*b*, 140*c*, 140*d*, 140*e* may be positioned along the longitudinal axis $A_L$ of the tool 100 in any order. In some embodiments, like cleaning sheets 140 (e.g., one first cleaning sheet 140*a* and another first cleaning sheet 140*a*) may be separated by one or more different cleaning sheets 140 (e.g., a second cleaning sheet 140*b*). In other embodiments, like cleaning sheets 140 may be positioned adjacent one another. It will be appreciated that any number of the cleaning sheets 140 and any combination of the different cleaning sheets 140*a*, 140*b*, 140*c*, 140*d*, 140*e* may be used in the first tool 100 for cleaning the various surfaces of the grooves 70 of the rotor disk 60.

As shown, the first tool 100 also may include a handle 190 that is rigidly attached to guide mount 130 and positioned along the top side 106 of the tool 100. In some embodiments, as shown, the handle 190 may be formed as an elongated member having opposite ends that are attached, either fixedly or removably, to the guide mount 130, although other shapes and configurations of the handle 190 may be used. The handle 190 may be configured to be grasped by a user such that the user may easily move the first tool 100 through the grooves 70 of the rotor disk 60 during cleaning. The handle 190 may be formed of a rigid and durable material. In some embodiments, the handle 190 may be formed of a plastic, although other rigid materials, including suitable metals or composites, may be used in other embodiments.

FIGS. 2Q and 2R illustrate a method of using the first tool 100 for cleaning the grooves 70 of the rotor disk 60. A user may grasp the handle 190 of the first tool 100 and insert one of the guides 120 (the "first" guide 120) into one of the grooves 70 in an axial manner (i.e., in the direction of the longitudinal axis $A_{LG}$ of the groove 70). The first guide 120 may be inserted into the groove 70 from either the upstream end 76 or the downstream end 78 thereof. As described above, the guide 120 may guide the first tool 100 into and through the groove 70, as the slots 122 and the ribs 124 of the guide 120 engage the third ribs 74*c* and the third slots 72*c* of the groove 70, respectively. In particular, the guide 120 may engage the third radially-outward-facing surfaces 90*c* and the third radially-inward-facing surfaces 92*c* of the groove 70, as shown. In some embodiments, as shown, the guide 120 also may engage the first circumferentially-outer surfaces 86*a* of the groove 70. In this manner, the guide 120 may guide the first tool 100 into and through the groove 70. The user may axially move (i.e., translate) the first tool 100 in the upstream direction or the downstream direction until the first guide 120 and the cleaning sheets 140 have passed through the groove 70, while the second guide 120 remains at least partially within the groove 70. The user then may axially move the first tool 100 in the opposite direction until the second guide 120 and the cleaning sheets 140 have passed through the groove 70, while the first guide 120 remains at least partially within the groove 70. Such axial movement of the first tool 100 may be repeated, back and forth in the upstream direction and the downstream direction, as the contact portions 164 of the cleaning sheets 140 repeatedly contact the respective surfaces of the groove 70 and remove contaminants therefrom and the guides 120 maintain proper orientation of the first tool 100 with respect to the groove 70.

As the cleaning sheets 140 pass through the groove 70, the contact portions 164*a* of the first cleaning sheets 140*a* may contact and clean the bottom surface 84 of the groove 70, the contact portions 164*b* of the second cleaning sheets 140*b* may contact and clean the circumferentially-outer surfaces 86*a*, 86*b*, 86*c* of the groove 70, the contact portions 164*c* of the third cleaning sheets 164*c* may contact and clean the circumferentially-inner surfaces 88*a*, 88*b*, 88*c* of the groove 70, the contact portions 164*d* of the fourth cleaning sheets 140*d* may contact and clean the radially-inward-facing surfaces 92*a*, 92*b*, 92*c* of the groove 70, and the contact portions 164*e* of the fifth cleaning sheets 140*e* may contact and clean the radially-outward-facing surfaces 90*a*, 90*b*, 90*c* of the groove 70. In this manner, the different cleaning sheets 140*a*, 140*b*, 140*c*, 140*d*, 140*e* may contact and clean different surfaces of the groove 70, while the cleaning sheets 140 collectively contact and clean all of the surfaces of the groove 70. The cleaning method may be carried out with respect to each of the grooves 70 of the rotor disk 60, one groove 70 at a time. Further aspects of the method of cleaning the grooves 70 with the first tool 100 will be appreciated from the description of the tool 100 above.

FIGS. 3A-3F show an embodiment of a second tool 200 (which also may be referred to as a "finishing tool") as may be described herein. The second tool 200 may be used for finishing cleaning grooves of a rotor disk, such as the grooves 70 of the rotor disk 60 described above. In particular, the second tool 200 may be used for removing amounts of hardened dirt, oxidation residue, and/or other contaminants that may remain on the various surfaces of the grooves 70 of the rotor disk 60 after cleaning carried out with the first tool 100. As shown, the second tool 200 may have a generally elongated shape, with a longitudinal axis $A_L$ extending along a length $L_T$ of the tool 200, a first transverse axis $A_{T1}$ extending long a height $H_T$ of the tool 200, and a second transverse axis $A_{T2}$ extending long a width $W_T$ of the tool 200. In this manner, the second tool 200 may have a first end 202 and a second end 204 positioned opposite one another along the longitudinal axis $A_L$ of the tool 200, a top side 206 and a bottom side 208 positioned opposite one another along the first transverse axis $A_{T1}$ of the tool 200, and a first lateral side 212 and a second lateral side 214 positioned opposite one another along the second transverse axis $A_{T2}$ of the tool 200.

As shown, the second tool 200 may include a pair of guides 220 spaced apart from one another in the direction of the longitudinal axis $A_L$ of the tool 200. The guides 220 may be configured to guide the second tool 200 into and through the grooves 70 of the rotor disk 60, one groove 70 at a time, as described in detail below. Each of the guides 220 may have an elongated shape, with a length $L_G$ in the direction of the longitudinal axis $A_L$ of the tool 200, a height $H_G$ in the direction of the first transverse axis $A_{T1}$ of the tool 200, and a width $W_G$ in the direction of the second transverse axis $A_{T2}$ of the tool 200. As shown, at least a portion of each of the guides 220 may be shaped to have a cross-sectional profile, taken perpendicular to the longitudinal axis $A_L$ of the tool 200 (i.e., viewed from one of the ends 202, 204 of the tool 200), which corresponds to the cross-sectional profile of the groove 70 of the rotor disk 60. In particular, each guide 220 may include a number of slots 222 corresponding to a number of the ribs 74 of the groove 70, and a number of ribs 224 corresponding to a number of the slots 72 of the groove 70. The cross-sectional profile of the slots 222 of the guide 220 may be slightly greater than the cross-sectional profile of the ribs 74 of the groove 70, such that the ribs 74 may be movably received within the slots 222 without jamming. In a similar manner, the cross-sectional profile of the ribs 224 of the guide 220 may be slightly less than the cross-sectional profile of the slots 72 of the groove 70, such that the ribs 224 may be movably received within the slots 72 without jamming.

In some embodiments, as shown, each guide 220 may include a pair of slots 222 positioned opposite one another in a direction of the second transverse axis $A_{T2}$ of the tool 200, and a pair of ribs 224 positioned opposite one another in the direction of the second transverse axis $A_{T2}$. In some embodiments, the slots 222 may be configured to receive the third ribs 74*c* of the groove 70, respectively, and the ribs 224 may be configured to be received within the third slots 72*c* of the groove 70, respectively. In other embodiments, the slots 222 may be configured to receive the first ribs 74*a* or the second ribs 74*b* of the groove 70, respectively, and the ribs 224 may be configured to be received within the first slots 72*a* or the second slots 72*b* of the groove 70, respectively. Although each guide 220 is shown as including two (2) slots 222 and two (2) ribs 224 in the illustrated embodiment, each guide 220 may include any number of slots 222 and any number of ribs 224, corresponding to the number of ribs 74 and the number of slots 72 of the groove 70, in other embodiments.

As shown, each guide 220 may include a first portion 226 having a cross-sectional profile, taken perpendicular to the longitudinal axis $A_L$ of the tool 200, which corresponds to the cross-sectional profile of the groove 70 of the rotor disk 60, and a second portion 228 having a cross-sectional profile which does not correspond to the cross-sectional profile of the groove 70. The first portion 226 may include the slots 222 and the ribs 224, and the second portion 228 may be devoid of any slots and ribs, as shown. In some embodiments, as shown, the first portion 226 may be an upper portion (i.e., closer to the top side 206 of the tool 200) of the guide 220, and the second portion 228 may be a lower portion (i.e., closer to the bottom side 208 of the tool 200) of the guide 220. In other embodiments, the first portion 226 may be a lower portion or an intermediate portion of the guide 220, and the second portion 228 may be an upper portion or an intermediate portion of the guide 220.

Each of the guides 220 may be formed of a non-abrasive material that is softer than the material of which the rotor disk 60 is formed. In this manner, the guides 220 may pass through the grooves 70 of the rotor disk 60 and contact one or more surfaces of the grooves 70, without scratching or otherwise harming such surfaces. In some embodiments, the guides 220 may be formed of nylon, although other non-abrasive materials, including suitable plastics, composites, or metals, may be used in other embodiments. In some embodiments, as shown, the guides 220 may have an identical shape and configuration. In other embodiments, one of the guides 220 may have a different shape and/or configuration than the other guide 220.

As shown, the guides 220 may be rigidly attached to a common guide mount 230. The guide mount 230 may be formed as an elongated member spanning the length $L_T$ of the first tool 200. In some embodiments, as shown, the guide mount 230 may be formed as a plate, although other shapes of the guide mount 230 may be used in other embodiments. The guides 220 may be attached, either fixedly or removably, to the guide mount 230 to maintain the guides 220 in their spaced apart relationship in the direction of the longitudinal axis $A_L$ of the tool 200. In some embodiments, the guides 220 may be attached to the guide mount 230 via one or more fasteners, although other suitable attachment mechanisms may be used in other embodiments. The guide mount 230 may be formed of a rigid and durable material. In some embodiments, the guide mount 230 may be formed of a metal, such as stainless steel, although other rigid materials, including suitable plastics or composites, may be used in other embodiments.

The first tool 200 also may include a cleaning brush 234 positioned between and spaced apart from the guides 220 in the direction of the longitudinal axis $A_L$ of the tool 200. The cleaning brush 234 may be configured to pass through the grooves 70 of the rotor disk 60, one groove 70 at a time, and remove remaining contaminants from the various surfaces of the grooves 70, as described in detail below. As shown, the cleaning brush 234 may include a core 236 and a number of bristles 238 attached to the core 236. The core 236 generally may be formed as an elongated member having a longitudinal axis that extends in the direction of the first transverse axis $A_{T1}$ of the tool 200. In some embodiments, as shown, the core 236 may have a cylindrical shape with a circular cross-sectional shape, although other shapes of the core 236 may be used in other embodiments. The core 236, and thus the overall cleaning brush 234, may be configured to rotate about the longitudinal axis of the core 236, relative to the guide mount 230, as described in detail below. Each of the bristles 238 may be formed as a flexible elongated member having a wire-like shape and extending from the core 236. In this manner, each bristle 238 may have a fixed end that is fixedly attached to the core 236 and a free end that is spaced apart from the core 236. Each bristle 238 may extend away from the core 236 in a direction transverse to the longitudinal axis of the core 236, although different bristles 238 may have different orientations with respect to the core 236. Any number of bristles 238 may be used for the cleaning brush 234.

The shape of the cleaning brush 234 may be generally symmetric about the longitudinal axis of the brush 234, as shown. In other words, the bristles 238 may be positioned along the core 236 such that the profile of the cleaning brush 234 is generally consistent along the circumference of the brush 234. The number of bristles 238 may collectively form a bristle portion 240 of the cleaning brush 234. As shown, at least a portion of the bristle portion 240 may be shaped to have a cross-sectional profile, taken perpendicular to the longitudinal axis $A_L$ of the second tool 200 (i.e., viewed from one of the ends 202, 204 of the tool 200), which corresponds to the cross-sectional profile of the groove 70 of the rotor disk 60. In some embodiments, as shown, the bristle portion 240 may have a dovetail shape having a fir-tree configuration, when viewed from one of the ends 202, 204 of the tool 200. In particular, the bristle portion 240 may include a number of recesses 242 corresponding to a number of the ribs 74 of the groove 70, and a number of shoulders 244 corresponding to a number of the slots 72 of the groove 70. As shown, the bristle portion 240 may have a bottom end 250 and a top end 252 positioned opposite one another in the direction of the first transverse axis $A_{T1}$ of the second tool 200.

In some embodiments, as shown, the bristle portion 240 may include a first recess 242*a* (which also may be referred to as a "lower recess"), a second recess 242*b* (which also may be referred to as an "intermediate recess"), a third recess 242*c* (which also may be referred to as an "upper recess"), a first shoulder 244*a* (which also may be referred to as a "lower shoulder"), a second shoulder 244*b* (which also may be referred to as an "intermediate shoulder"), and a third shoulder 244*c* (which also may be referred to as an "upper shoulder"). In some embodiments, as shown, each of the recesses 242*a*, 242*b*, 242*c* and each of the shoulders 244*a*, 244*b*, 244*c* may extend about the longitudinal axis of the cleaning brush 234 along the entire circumference of the brush 234. Although the bristle portion 240 is shown as including three (3) recesses 242 and three (3) shoulders 244 in the illustrated embodiment, the bristle portion 240 may include any number of recesses 242 and any number of shoulders 244, corresponding to corresponding to respective pairs of the number of ribs 74 and the number of slots 72 of the groove 70, in other embodiments.

Figure 3A:
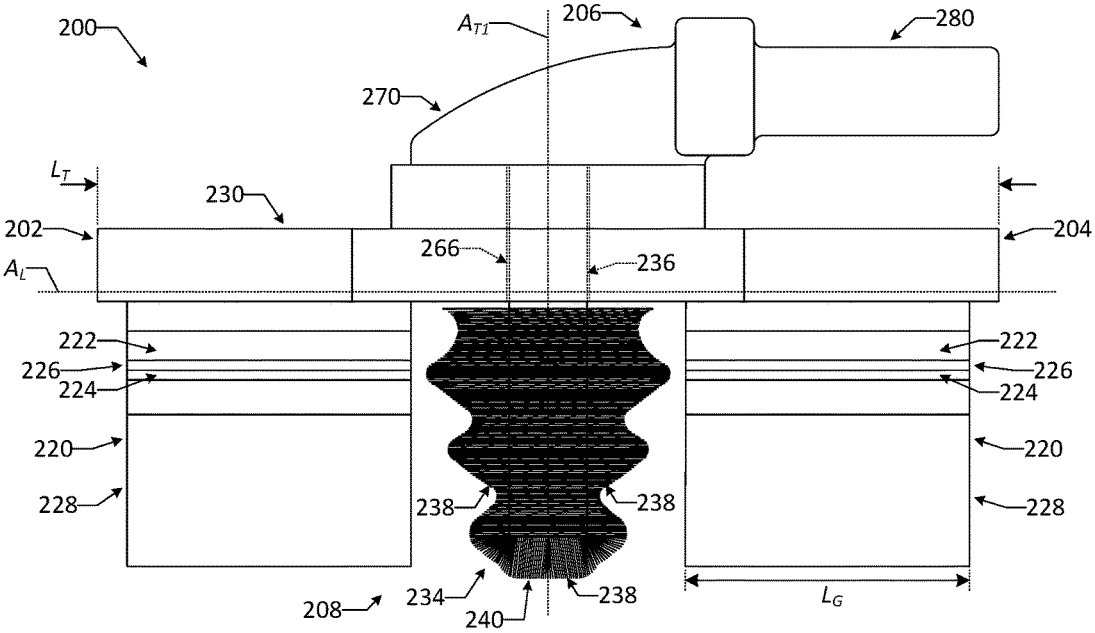
FIG. 3A is a side view of an embodiment of a second tool for finishing cleaning grooves of a rotor disk as may be described herein, the second tool including a pair of guides, a guide mount, a cleaning brush, a motor housing, a motor, and a handle.
Figure 3B:
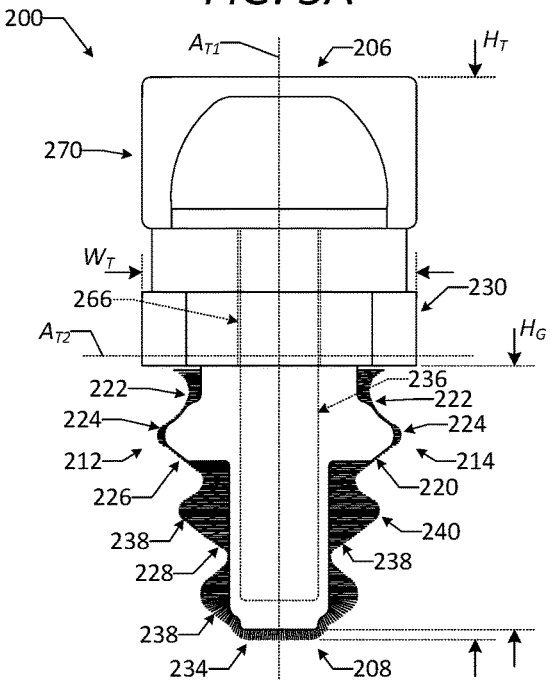
FIG. 3B is an end view of the second tool of FIG. 3A.
Figure 3C:
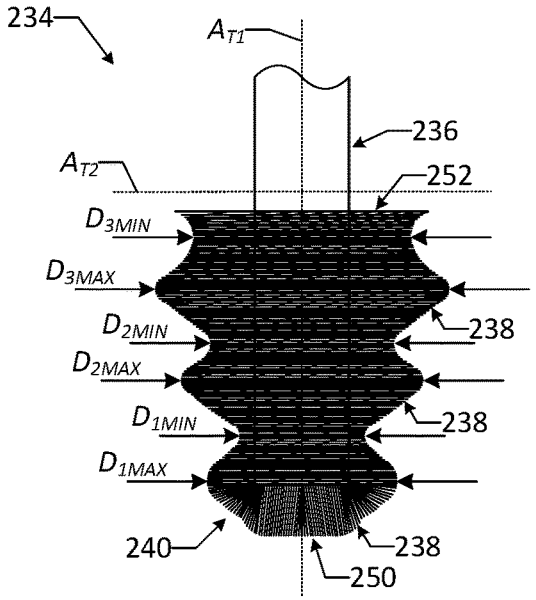
FIG. 3C is an end view of the cleaning brush of the second tool of FIG. 3A, showing distances between features of the cleaning brush.
Figure 3D:
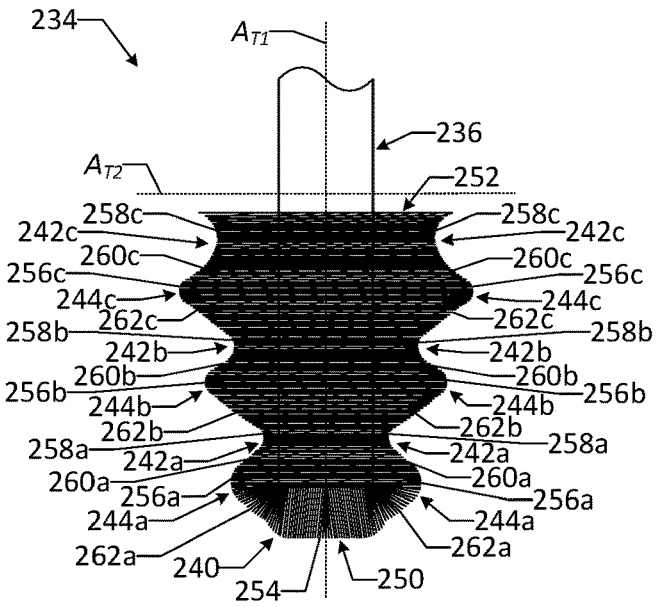
FIG. 3D is an end view of the cleaning brush of the second tool of FIG. 3A, showing a number of recesses, a number of shoulders, and various faces of the cleaning brush.

As shown in FIG. 3C, opposite sides of the first recess 242*a* may be spaced apart from one another by a first minimum distance $D_{1MIN}$, opposite sides of the second recess 242*b* may be spaced apart from one another by a second minimum distance $D_{2MIN}$, and opposite sides of the third recess 242*c* may be spaced apart from one another by a third minimum distance $D_{3MIN}$, in the direction of the second transverse axis $A_{T2}$ of the tool 200. In some embodiments, as shown, the first minimum distance $D_{1MIN}$ may be less than the second minimum distance $D_{2MIN}$, and the second minimum distance $D_{2MIN}$ may be less than the third minimum distance $D_{3MIN}$. The opposite sides of first shoulder 244*a* may be spaced apart from one another by a first maximum distance $D_{1MAX}$, opposite sides of the second shoulder 244*b* may be spaced apart from one another by a second maximum distance $D_{2MAX}$, and opposite sides of the third shoulder 244*c* may be spaced apart from one another by a third maximum distance $D_{3MAX}$, in the direction of the second transverse axis $A_{T2}$. In some embodiments, as shown, the first maximum distance $D_{1MAX}$ may be less than the second maximum distance $D_{2MAX}$, and the second maximum distance $D_{2MAX}$ may be less than the third maximum distance $D_{3MAX}$. Further, the first minimum distance $D_{1MIN}$ may be less than the first maximum distance $D_{1MAX}$, the second minimum distance $D_{2MIN}$ may be less than the second maximum distance $D_{2MAX}$, and the third minimum distance $D_{3MIN}$ may be less than the third maximum distance $D_{3MAX}$.

The bristle portion 240 may include a number of different faces extending along the exterior of the bristle portion 240. As used herein, the term "face" refers to a region of the exterior of the bristle portion 240 collectively defined by the free ends of a number of the bristles 238. In this manner, the term "face" does not require a continuous surface of the bristle portion 240. As shown, the bristle portion 240 may include a bottom face 254 extending along the bottom end 250 of the bristle portion 240. In some embodiments, the bottom face 254 may be a planar face. In other embodiments, the bottom face 254 may be a curved face. The bristle portion 240 also may include a number of laterally-outer faces 256 corresponding to the number of shoulders 244 of the bristle portion 240 and extending along the entire circumference of the bristle portion 240. In particular, the bristle portion 240 may include a first laterally-outer face 256*a*, a second laterally-outer face 256*b*, and a third laterally-outer face 256*c*, as shown. In some embodiments, each of the laterally-outer faces 256 may be a curved face. In other embodiments, each of the laterally-outer faces 256 may be a planar face. The bristle portion 240 further may include a number of laterally-inner faces 258 corresponding to the number of recesses 242 of the bristle portion 240 and extending along the entire circumference of the bristle portion 240. In particular, the bristle portion 240 may include a first laterally-inner face 258*a*, a second laterally-inner face 258*b*, and a third laterally-inner face 258*c*, as shown. In some embodiments, each of the laterally-inner faces 258 may be a curved face. In other embodiments, each of the laterally-inner faces 258 may be a planar face.

As shown, the bristle portion 240 also may include a number of top-facing faces 260 corresponding to the number of recesses 242 and the number of shoulders 244 of the bristle portion 240 and extending along the entire circumference of the bristle portion 240. In particular, the bristle portion 240 may include a first top-facing face 260*a*, a second top-facing face 260*b*, and a third top-facing face 260*c*, as shown. In some embodiments, each of the top-facing faces 260 may be a planar face. In other embodiments, each of the top-facing faces 260 may be a curved face. The bristle portion 240 further may include a number of bottom-facing faces 262 corresponding to the number of recesses 242 and the number of shoulders 244 of the bristle portion 240 and extending along the entire circumference of the bristle portion 240. In particular, the bristle portion 240 may include a first bottom-facing face 262*a*, a second bottom-facing face 262*b*, and a third bottom-facing face 262*c*, as shown. In some embodiments, each of the bottom-facing faces 262 may be a planar face. In other embodiments, each of the bottom-facing faces 262 may be a curved face.

As described above, the cleaning brush 234 may be configured to pass through the grooves 70 of the rotor disk 60, one groove 70 at a time, and remove remaining contaminants from the various surfaces of the groove 70. The bristles 238 of each of the faces 254, 256, 258, 260, 262 of the bristle portion 240 may be configured to contact one or more surfaces of the groove 70 as the bristle portion 240 passes through the groove 70 and rotates about the longitudinal axis of the cleaning brush 234. In particular, the bristles 238 of the bottom face 254 may be configured to contact and clean the radially inner surface 84 of the groove 70, the bristles 238 of the laterally-outer faces 256 may be configured to contact and clean the respective circumferentially-outer surfaces 86*a*, 86*b*, 86*c* of the groove 70, the bristles 238 of the laterally-inner faces 258 may be configured to contact and clean the respective circumferentially-inner surfaces 88*a*, 88*b*, 88*c* of the groove 70, the bristles 238 of the top-facing faces 260 may be configured to contact and clean the respective radially-inward-facing surfaces 92*a*, 92*b*, 92*c* of the groove 70, and the bristles 238 of the bottom-facing faces 262 may be configured to contact and clean the respective radially-outward-facing surfaces 90*a*, 90*b*, 90*c* of the groove 70. In this manner, the bristles 238 of the different faces 254, 256, 258, 260, 262 of the bristle portion 240 may contact and clean different surfaces of the groove 70, while all of the bristles 238 collectively contact and clean all of the surfaces of the groove 70.

The bristles 238 of the different faces 254, 256, 258, 260, 262 of the bristle portion 240 may be sized and configured to interfere with the respective surfaces of the groove 70 as the as the bristle portion 240 passes through the groove 70 and rotates about the longitudinal axis of the cleaning brush 234. To accommodate such interference, the bristles 238 may be flexible such that the free end of each bristle 238 may be deflected with respect to the fixed end of the bristle 238. In this manner, as the bristle portion 240 passes through the groove 70 and bristles 238 of the different faces 254, 256, 258, 260, 262 interfere with the respective surfaces thereof, the bristles 238 may be resiliently deflected at least partially away from their natural position (i.e., deflected circumferentially about the longitudinal axis of the cleaning brush 234 in the direction opposite the direction of rotation of the cleaning brush 234) while maintaining contact with the respective surfaces of the groove 70. The force imparted by the bristles 238 on the respective surfaces of the groove 70 may be sufficient to remove remaining contaminants therefrom as the bristle portion 240 passes through the groove 70. In view of the rotating movement of the cleaning brush 234, it will be appreciated that the bristles 238 of the different faces 254, 256, 258, 260, 262 may engage and disengage the respective surfaces of the groove 70 as the bristle portion 240 passes through the groove 70. In this manner, when the bristle portion 240 is positioned within the groove 70, some of the bristles 238 of each of the different faces 254, 256, 258, 260, 262 may engage the respective surfaces of the groove 70, while other bristles 238 of the different faces 254, 256, 258, 260, 262 may not engage the respective surfaces.

The core 236 may be formed of a rigid and durable material. In some embodiments, the core 236 may be formed of a metal, such as stainless steel, although a plastic, a composite, or other suitable rigid materials may be used in other embodiments. The bristles 238 may be formed of a flexible and durable material. In some embodiments, the bristles 238 may be formed of a metal, such as stainless spring steel, although a plastic, a composite, or other suitable flexible materials may be used in other embodiments.

As described above, the cleaning brush 234 may be configured to rotate with respect to the guide mount 230. In some embodiments, as shown, the core 236 of the cleaning brush 234 may extend through and be supported within a mounting hole 266 of the guide mount 230. In other embodiments, a drive shaft may extend through the mounting hole 266 and be coupled to the core 236 to facilitate rotation of the cleaning brush 234. Although the illustrated embodiment shows the second tool 200 as including a single cleaning brush 234, two or more cleaning brushes 234 may be used in other embodiments. For example, second tool 200 may include two cleaning brushes 234 positioned between the guides 220 and spaced apart from one another with parallel longitudinal axes. In such embodiments, one of the cleaning brushes 234 may rotate in a first direction, and the other cleaning brush 234 may rotate in a second direction opposite the first direction. Other configurations of the cleaning brushes 234 may be used herein.

As shown, the second tool 200 also may include a motor M (illustrated schematically in FIG. 3F) in communication, either directly or indirectly via additional components, with the core 236 of the cleaning brush 234. In some embodiments, the motor M may be an electric motor, although other types of motors may be used in other embodiments. When activated, the motor M may rotate the cleaning brush 234 about the longitudinal axis thereof. As shown, the motor M may be positioned within a motor housing 270, along with electronics and controls necessary to control activation and operation of the motor M during use of the tool 200. In some embodiments, as shown, the motor M and the motor housing 270 may be positioned above the guide mount 230 along the top side 206 of the second tool 200, although other positions may be used in other embodiments. The motor housing 270 may be formed of a rigid and durable material. In some embodiments, the motor housing 270 may be formed of a plastic, although other rigid materials, including suitable metals or composites, may be used in other embodiments.

As shown, the second tool 200 also may include a handle 280 positioned along the top side 206 of the tool 200. In some embodiments, as shown, the handle 280 may be formed as an elongated member that is rigidly attached to the motor housing 270 and extends away from the motor housing 270, although other shapes and configurations of the handle 280 may be used herein. The handle 280 may be configured to be grasped by a user such that the user may easily move the second tool 200 through the grooves 70 of the rotor disk 60 during cleaning. The handle 280 may be formed of a rigid and durable material. In some embodiments, the handle 280 may be formed of a plastic, although other rigid materials, including suitable metals or composites, may be used in other embodiments.

Figure 3E:
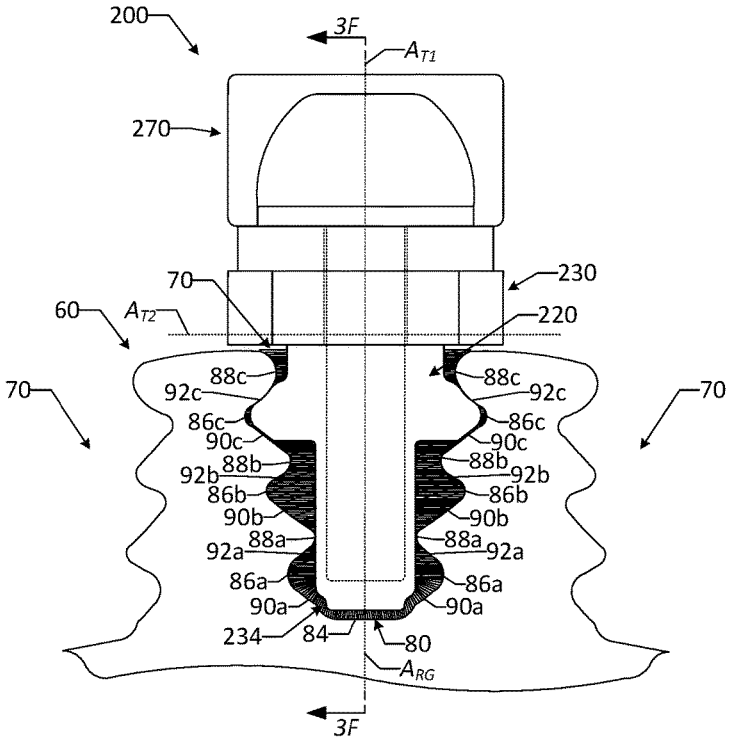
FIG. 3E is an end view of the second tool of FIG. 3A positioned within a groove of a rotor disk.
Figure 3F:
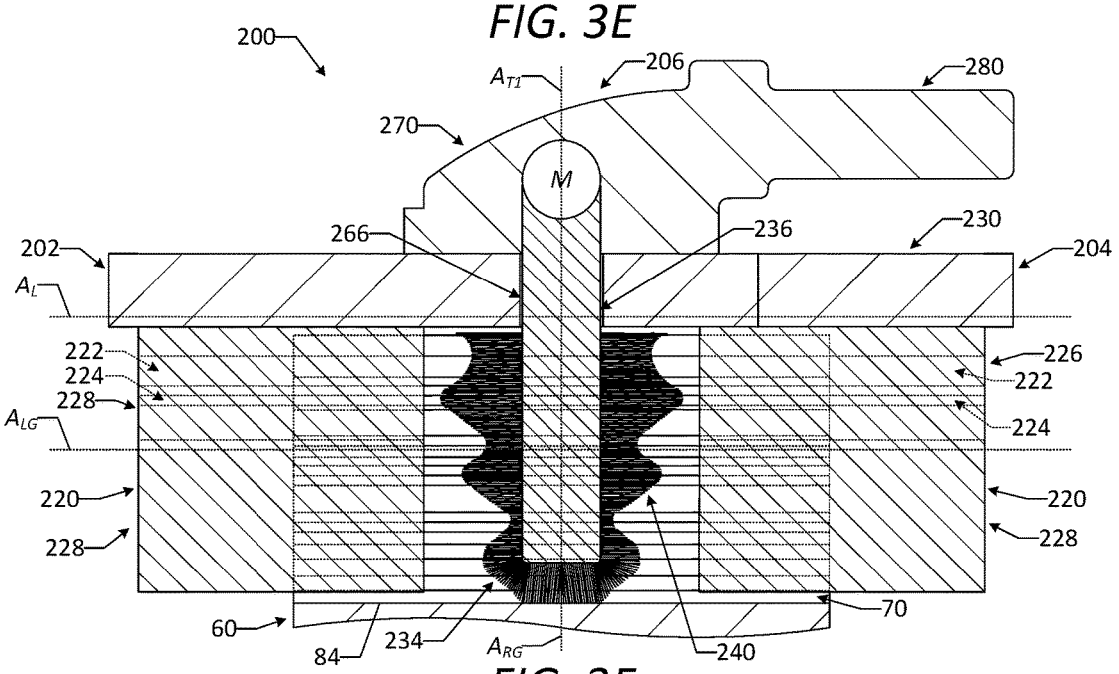
FIG. 3F is a cross-sectional side view of the second tool of FIG. 3A positioned within the groove of the rotor disk of FIG. 3E, taken along line 3F-3F.

FIGS. 3E and 3F illustrate a method of using the second tool 200 for finishing cleaning the grooves 70 of the rotor disk 60. As explained above, the second tool 200 may be used after use of the first tool 100. A user may grasp the handle 280 of the second tool 200, activate the motor M to rotate the cleaning brush 234, and insert one of the guides 220 (the "first" guide 220) into one of the grooves 70 in an axial manner (i.e., in the direction of the longitudinal axis $A_{LG}$ of the groove 70). The first guide 220 may be inserted into the groove 70 from either the upstream end 76 or the downstream end 78 thereof. As described above, the guide 220 may guide the second tool 200 into and through the groove 70, as the slots 222 and the ribs 224 of the guide 220 engage the third ribs 74*c* and the third slots 72*c* of the groove 70, respectively. In particular, the guide 220 may engage the third radially-outward-facing surfaces 90*c* and the third radially-inward-facing surfaces 92*c* of the groove 70, as shown. In some embodiments, as shown, the guide 220 also may engage the first circumferentially-outer surfaces 86*a* of the groove 70. In this manner, the guide 220 may guide the second tool 200 into and through the groove 70. The user may axially move (i.e., translate) the second tool 200 in the upstream direction or the downstream direction until the first guide 220 and the bristle portion 240 of the cleaning brush 234 have passed through the groove 70, while the second guide 220 remains at least partially within the groove 70. The user then may axially move the second tool 200 in the opposite direction until the second guide 220 and the bristle portion 240 have passed through the groove 70, while the first guide 220 remains at least partially within the groove 70. Such axial movement of the second tool 200 may be repeated, back and forth in the upstream direction and the downstream direction, as the different faces 254, 256, 258, 260, 262 of the bristle portion 240 repeatedly contact the respective surfaces of the groove 70 and remove contaminants therefrom and the guides 220 maintain proper orientation of the second tool 200 with respect to the groove 70.

As the bristle portion 240 rotates and passes through the groove 70, the bristles 238 of the bottom face 254 may contact and clean the radially inner surface 84 of the groove 70, the bristles 238 of the laterally-outer faces 256 may contact and clean the respective circumferentially-outer surfaces 86*a*, 86*b*, 86*c* of the groove 70, the bristles 238 of the laterally-inner faces 258 may contact and clean the respective circumferentially-inner surfaces 88*a*, 88*b*, 88*c* of the groove 70, the bristles 238 of the top-facing faces 260 may contact and clean the respective radially-inward-facing surfaces 92*a*, 92*b*, 92*c* of the groove 70, and the bristles 238 of the bottom-facing faces 262 may contact and clean the respective radially-outward-facing surfaces 90*a*, 90*b*, 90*c* of the groove 70. In this manner, the different faces 254, 256, 258, 260, 262 of the bristle portion 240 may contact and clean different surfaces of the groove 70, while the faces 254, 256, 258, 260, 262 collectively contact and clean all of the surfaces of the groove 70. The cleaning method may be carried out with respect to each of the grooves 70 of the rotor disk 60, one groove 70 at a time. Further aspects of the method of finishing cleaning the grooves 70 with the second tool 200 will be appreciated from the description of the tool 200 above.

Figure 3G:
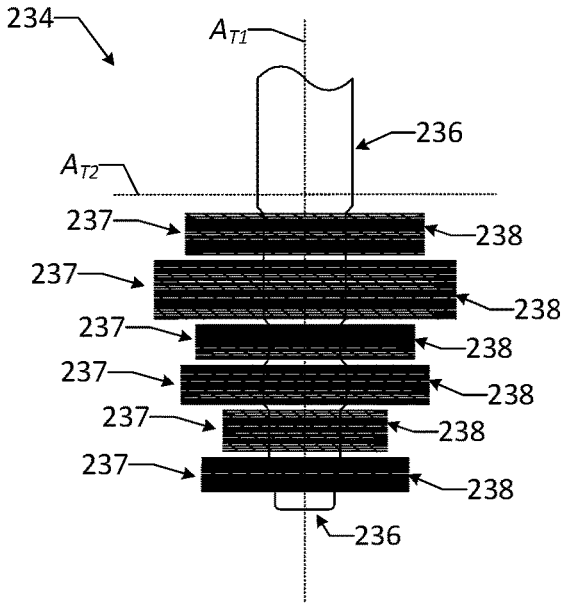
FIG. 3G is an end view of another cleaning brush for the second tool of FIG. 3A

FIG. 3G shows an alternative configuration of the cleaning brush 234 of the first tool 200. According to the illustrated embodiment, the cleaning brush 234 may include a number of separate components attached to one another. In particular, the cleaning brush 234 may include a core 236 and a number of brush rings 237 attached thereto. Each brush ring 237 may include a ring support and a number of bristles 238 extending therefrom. As shown, the various brush rings 237 may have various different outer diameters and the ring supports thereof also may have different diameters to adequately support the bristles 238 attached thereto. In this manner, the brush rings 237 may be sized to generally correspond to the contour of the groove 70 of the rotor disk 60. The diameter of the core 236 also may vary in the direction of the first transverse axis $A_{T1}$, and the core 236 may include a number of separate portions attached to one another. In this manner, the portions of the core 236 may accommodate the different diameters of the ring supports of the brush rings 237. It will be appreciated that the cleaning brush 234 may be used in a manner similar to that described above.

FIGS. 4A-4F show an embodiment of a third tool 300 (which also may be referred to as a "grinding tool") as may be described herein. The third tool 300 may be used for grinding material from certain surfaces of grooves of a rotor disk, such as the grooves 70 of the rotor disk 60 described above. In particular, the third tool 300 may be used for grinding away amounts of sintered material that may be present on certain surfaces of the grooves 70 of the rotor disk 60 after cleaning carried out with the first tool 100 and the second tool 200. As shown, the third tool 300 may have a generally elongated shape, with a longitudinal axis $A_L$ extending along a length $L_T$ of the tool 300, a first transverse axis $A_{T1}$ extending long a height $H_T$ of the tool 300, and a second transverse axis $A_{T2}$ extending long a width $W_T$ of the tool 300. In this manner, the third tool 300 may have a first end 302 and a second end 304 positioned opposite one another along the longitudinal axis $A_L$ of the tool 300, a top side 306 and a bottom side 308 positioned opposite one another along the first transverse axis $A_{T1}$ of the tool 300, and a first lateral side 312 and a second lateral side 314 positioned opposite one another along the second transverse axis $A_{T2}$ of the tool 300.

As shown, the third tool 300 may include a support 318 positioned along the top side 306 of the tool 300. The support 318 may be formed as an elongated member spanning the length $L_T$ of the third tool 300. In some embodiments, as shown, the support 318 may be formed as a plate, although other shapes of the support 318 may be used in other embodiments.

The third tool 300 also may include a guide 320 positioned along the bottom side 308 of the tool 300. The guide 320 may be configured to guide the third tool 300 into and through the grooves 70 of the rotor disk 60, one groove 70 at a time, as described in detail below. In some embodiments, as shown, the support 318 and the guide 320 may be integrally formed with one another (i.e., the support 318 and the guide 320 may be formed as a single member from the same material). In other embodiments, the support 318 and the guide 320 may be separately formed and rigidly attached to one another. The guide 320 may have an elongated shape, with a length $L_G$ in the direction of the longitudinal axis $A_L$ of the tool 300, a height $H_G$ in the direction of the first transverse axis $A_{T1}$ of the tool 300, and a width $W_G$ in the direction of the second transverse axis $A_{T2}$ of the tool 300. In some embodiments, as shown, the guide 320 may span the length $L_T$ of the third tool 300. As shown, at least a portion of the guide 320 may be shaped to have a cross-sectional profile, taken perpendicular to the longitudinal axis $A_L$ of the tool 300 (i.e., viewed from one of the ends 302, 304 of the tool 300), which corresponds to the cross-sectional profile of the groove 70 of the rotor disk 60. In other words, the guide 320 may have a partial dovetail shape having a "fir-tree" configuration, when viewed from one of the ends 302, 304 of the tool 300. In particular, the guide 320 may include a number of slots 322 corresponding to a number of the ribs 74 of the groove 70, and a number of ribs 324 corresponding to a number of the slots 72 of the groove 70. The slots 322 and the ribs 324 of the guide 320 may be defined along the second lateral side 314 of the third tool 300, and the guide 320 may include a planar surface 326 formed along the first lateral side 312 of the tool 300.

In some embodiments, as shown, the guide 320 may include a first slot 322*a* (which also may be referred to as a "lower slot"), a second slot 322*b* (which also may be referred to as an "intermediate slot"), a third slot 322*c* (which also may be referred to as an "upper slot"), a first rib 324*a* (which also may be referred to as a "lower rib"), a second rib 324*b* (which also may be referred to as an "intermediate rib"), and a third rib 324*c* (which also may be referred to as an "upper rib"). Each of the slots 322*a*, 322*b*, 322*c* and each of the ribs 324*a*, 324*b*, 324*c* may extend from the first end 302 to the second end 304 of the third tool 300. The first slot 322*a* may be configured to receive one of the first ribs 74*a* of the groove 70, the second slot 322*b* may be configured to receive one of the second ribs 74*b* of the groove 70, and the third slot 322*c* may be configured to receive one of the third ribs 74*c* of the groove 70. In a similar manner, the first rib 324*a* may be configured to be received within one of the first slots 72*a* of the groove 70, the second rib 324*b* may be configured to be received within one of the second slots 72*b* of the groove 70, and the third rib 324*c* may be configured to be received within one of the third slots 72*c* of the groove 70. Although the guide 320 is shown as including three (3) slots 322 and three (3) ribs 324 in the illustrated embodiment, the guide 320 may include any number of slots 322 and any number of ribs 324, corresponding to corresponding to the number of ribs 74 and the number of slots 72 of the groove 70, in other embodiments.

Figure 4A:
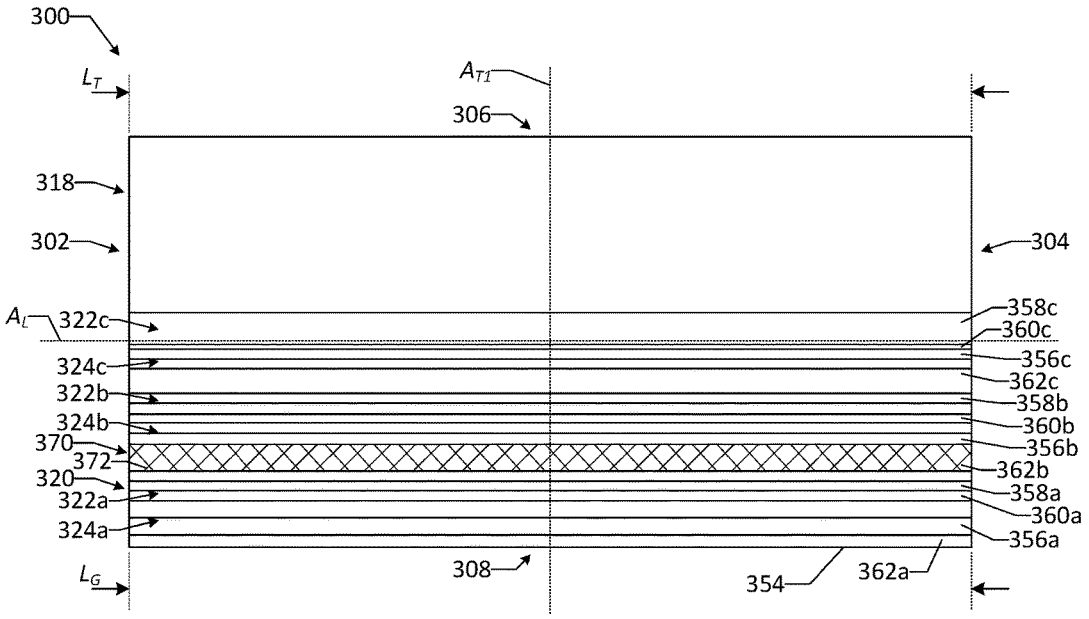
FIG. 4A is a side view of an embodiment of a third tool for cleaning grooves of a rotor disk as may be described herein, the second tool including a support, a guide, a number of slots, a number of ribs, and a coated region.
Figure 4B:
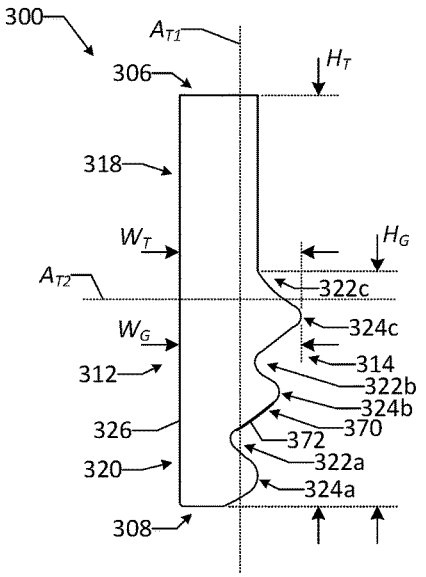
FIG. 4B is an end view of the third tool of FIG. 4A, showing a number of slots and a number of ribs of the guide.
Figure 4C:
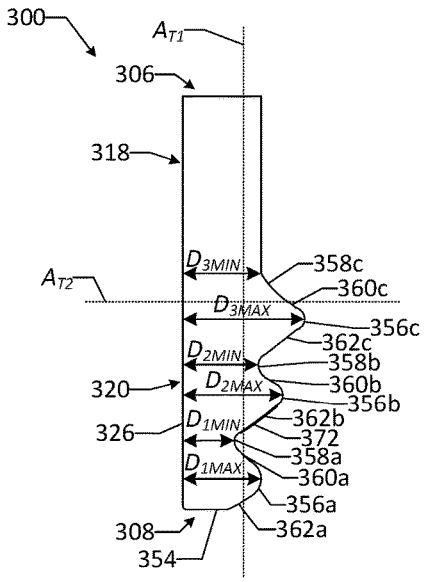
FIG. 4C is an end view of the third tool of FIG. 4A, showing a number of surfaces of the guide and distances between features of the guide.
Figure 4D:
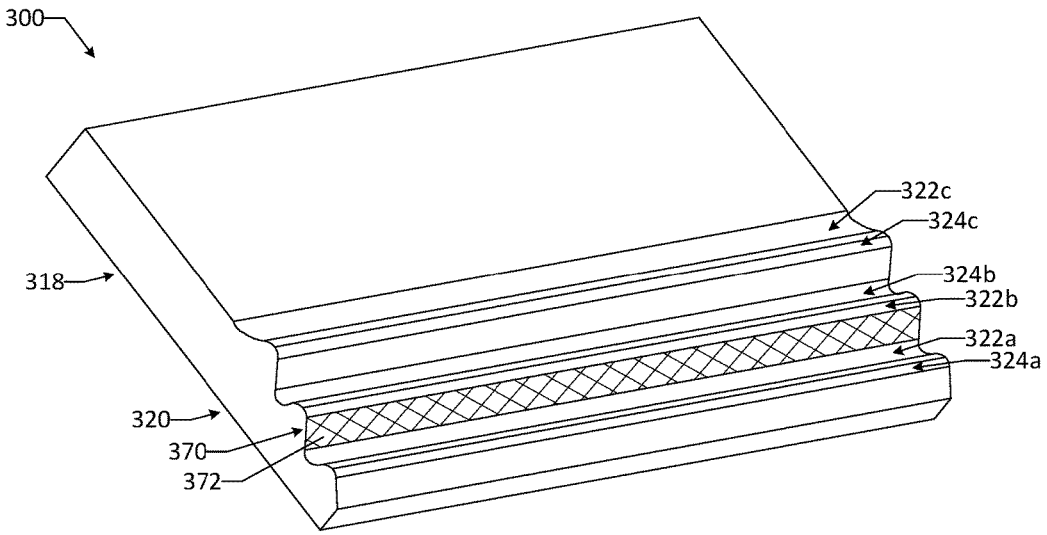
FIG. 4D is a perspective view of the third tool of FIG. 4A.

As shown in FIG. 4C, the first slot 322*a* may be spaced apart from the planar surface 326 by a first minimum distance $D_{1MIN}$, the second slot 322*b* may be spaced apart from the planar surface 326 by a second minimum distance $D_{2MIN}$, and the third slot 322*c* may be spaced apart from the planar surface 326 by a third minimum distance $D_{3MIN}$, in the direction of the second transverse axis $A_{T2}$ of the third tool 300. In some embodiments, as shown, the first minimum distance $D_{1MIN}$ may be less than the second minimum distance $D_{2MIN}$, and the second minimum distance $D_{2MIN}$ may be less than the third minimum distance $D_{3MIN}$. The first rib 324*a* may be spaced apart from the planar surface 326 by a first maximum distance $D_{1MAX}$, the second rib 324*b* may be spaced apart from the planar surface 326 by a second maximum distance $D_{2MAX}$, and the third rib 324*c* may be spaced apart from the planar surface 326 by a third maximum distance $D_{3MAX}$, in the direction of the second transverse axis $A_{T2}$. In some embodiments, as shown, the first maximum distance $D_{1MAX}$ may be less than the second maximum distance $D_{2MAX}$, and the second maximum distance $D_{2MAX}$ may be less than the third maximum distance $D_{3MAX}$. Further, the first minimum distance $D_{1MIN}$ may be less than the first maximum distance $D_{1MAX}$, the second minimum distance $D_{2MIN}$ may be less than the second maximum distance $D_{2MAX}$, and the third minimum distance $D_{3MIN}$ may be less than the third maximum distance $D_{3MAX}$.

The guide 320 of the third tool 300 may include a bottom surface 354 extending along the bottom side 308 of the tool 300 from the first end 302 to the second end 304 thereof. In some embodiments, the bottom surface 354 may be a planar surface. In other embodiments, the bottom surface 354 may be a curved surface. The guide 320 also may include a number of laterally-outer surfaces 356 corresponding to the number of slots 72 of the groove 70 and extending from the first end 302 to the second end 304 of the tool 300. In particular, the guide 320 may include a first laterally-outer surface 356*a*, a second laterally-outer surface 356*b*, and a third laterally-outer surface 356*c*, as shown. In some embodiments, each of the laterally-outer surfaces 356 may be a curved surface. In other embodiments, each of the laterally-outer surfaces 356 may be a planar surface. The guide 320 further may include a number of laterally-inner surfaces 358 corresponding to the number of ribs 74 of the groove 70 and extending from the first end 302 to the second end 304 of the tool 300. In particular, the guide 320 may include a first laterally-inner surface 358*a*, a second laterally-inner surface 358*b*, and a third laterally-inner surface 358*c*, as shown. In some embodiments, each of the laterally-inner surfaces 358 may be a curved surface. In other embodiments, each of the laterally-inner surfaces 358 may be a planar surface.

As shown, the guide 320 also may include a number of top-facing surfaces 360 corresponding to the number of slots 72 and the number of ribs 74 of the groove 70 and extending from the first end 302 to the second end 304 of the third tool 300. In particular, the guide 320 may include a first top-facing surface 360*a*, a second top-facing surface 360*b*, and a third top-facing surface 360*c*, as shown. In some embodiments, each of the top-facing surfaces 360 may be a planar surface. In other embodiments, each of the top-facing surfaces 360 may be a curved surface. The guide 320 further may include a number of bottom-facing surfaces 362 corresponding to the number of slots 72 and the number of ribs 74 of the groove 70 and extending from the first end 302 to the second end 304 of the tool 300. In particular, the guide 320 may include a first bottom-facing surface 362*a*, a second bottom-facing surface 362*b*, and a third bottom-facing surface 362*c*, as shown. In some embodiments, each of the bottom-facing surfaces 362 may be a planar surface. In other embodiments, each of the bottom-facing surfaces 362 may be a curved surface.

The support 318 and the guide 320 may be formed of a non-abrasive material that is softer than the material of which the rotor disk 60 is formed. In this manner, the support 318 and the guide 320 may pass through the grooves 70 of the rotor disk 60 and contact one or more surfaces of the grooves 70, without scratching or otherwise harming such surfaces. In some embodiments, the support 318 and the guide 320 may be formed of a metal, such as brass or aluminum, although other non-abrasive materials, including suitable plastics or composites, may be used in other embodiments.

As shown, the third tool 300 also may include one or more coated regions 370 (which also may be referred to as "contact regions" or "grinding regions") positioned along one or more of the surfaces of the guide 320. The one or more coated regions 370 may be configured to contact and grind the sintered material present on one or more of the surfaces of the groove 70, while the remaining surfaces of the guide 320 (i.e., the surfaces of "non-coated regions" of the guide 320) do not contact (i.e., are spaced apart from) the remaining corresponding surfaces of the groove 70. Each coated region 370 may be formed by a coating 372 (indicated by cross-hatching in FIGS. 4A and 4D) positioned over one or more of the surfaces of the guide 320. The coating 372 may be formed of a hard and abrasive material that is suitable for grinding sintered material. In some embodiments, the coating 372 may be formed of cubic bore nitride, although other suitable abrasive materials may be used in other embodiments.

In some embodiments, one or more coated regions 370 may be positioned along one or more of the bottom-facing surfaces 362 of the guide 320. For example, a single coated region 370 may be positioned along the second bottom-facing surface 362*b*, as shown in the illustrated embodiment. Alternatively, multiple coated regions 370 may be positioned along one or more, or all, of the bottom-facing surfaces 362 of the guide 320. In other embodiments, one or more coated regions 370 may be positioned along the bottom surface 354 of the guide 320. In still other embodiments, one or more coated regions 370 may be positioned along one or more, or all, of the laterally-outer surfaces 356 of the guide 320. In other embodiments, one or more coated regions 370 may be positioned along one or more, or all, of the laterally-inner surfaces 358 of the guide 320. In still other embodiments, one or more coated regions 370 may be positioned along one or more, or all, of the top-facing surfaces 360 of the guide 320.

During use of the third tool 300, the one or more coated regions 370 may contact and grind the sintered material present on the corresponding surfaces of the groove 70, while the surfaces of non-coated regions of the guide 320 are spaced apart from their corresponding surfaces of the groove 70. However, the non-coated regions of the guide 320 may be sized and configured to contact their corresponding surfaces of the groove 70 once the sintered material has been removed by the one or more coated regions 370. In this manner, the contact between the surfaces of the non-coated regions of the guide 320 and their corresponding surfaces of the groove 70 may prevent the one or more coated regions 370 from grinding or otherwise harming their corresponding surfaces of the groove 70 after removing the sintered material therefrom. Accordingly, the guide 320 may allow for controlled removal of sintered material from one or more surfaces of the groove 70, without compromising the shape of the groove 70. It will be appreciated that multiple versions of the third tool 300 may be used when sintered material is present on multiple surfaces of the groove 70, with each version of the tool 300 having one or more coated regions 370 configured to grind sintered material from different surfaces of the groove 70.

Figure 4E:
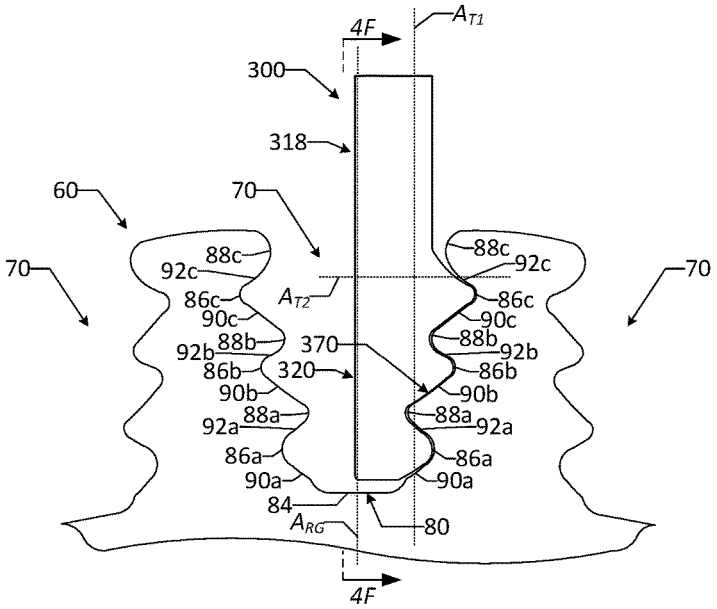
FIG. 4E is an end view of the third tool of FIG. 4A positioned within a groove of a rotor disk.
Figure 4F:
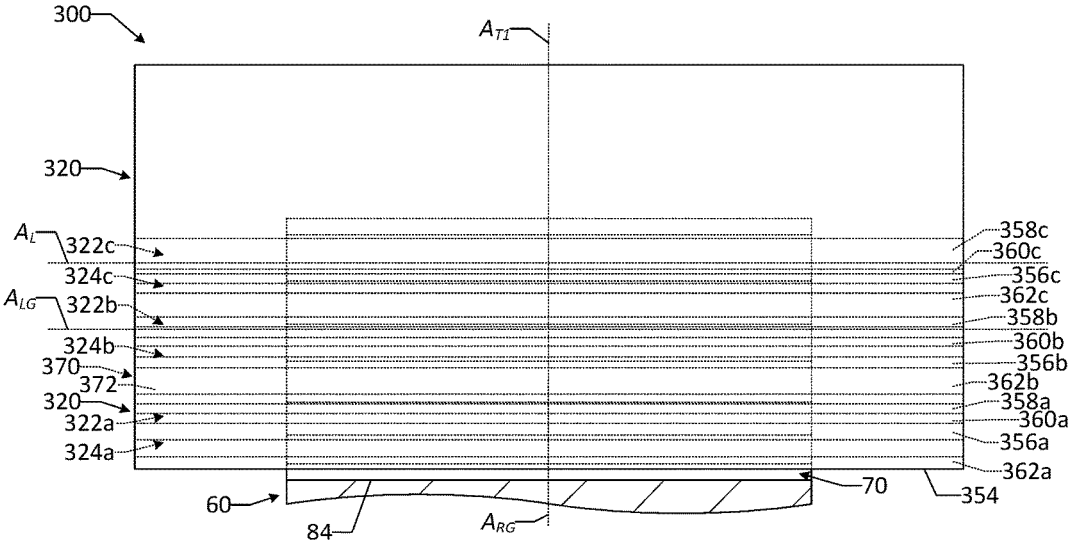
FIG. 4F is a cross-sectional side view of the third tool of FIG. 4A positioned within the groove of the rotor disk of FIG. 4E, taken along line 4F-4F.

FIGS. 4E and 4F illustrate a method of using the third tool 300 for grinding away sintered material present on certain surfaces of the grooves 70 of the rotor disk 60. As explained above, the third tool 300 may be used after use of the first tool 100 and the second tool 200. A user may grasp the support 318 of the third tool 300 and insert the guide 320 into one of the grooves 70 in an axial manner (i.e., in the direction of the longitudinal axis $A_{LG}$ of the groove 70). The guide 320 may be inserted into the groove 70 from either the upstream end 76 or the downstream end 78 thereof. The user also may press the guide 320 against one circumferential side of the groove 70, as shown. As described above, the guide 320 may guide the third tool 300 into and through the groove 70, as the slots 322 of the guide 320 receive the respective ribs 74 of the groove 70 and the ribs 324 of the guide 320 are received within the respective slots 72 of the groove 70. While maintaining pressure against the circumferential side of the groove 70, the user may axially move (i.e., translate) the third tool 300 in the upstream direction or the downstream direction until one of the ends 302, 304 of the tool 300 has passed through the groove 70, while the other end 302, 304 remains positioned within the groove 70. The user then may axially move the third tool 300 in the opposite direction until the other end 302, 304 has passed through the groove 70, while the one end 302, 304 remains positioned within the groove 70. Such axial movement of the third tool 300 may be repeated, back and forth in the upstream direction and the downstream direction, as the one or more coated regions 370 repeatedly contacts and grinds away sintered material from the respective one or more surfaces of the groove 70 and the guide 320 maintains proper orientation of the third tool 300 with respect to the groove 70.

As the guide 320 passes through the groove 70, the one or more coated regions 370 may contact and grind away sintered material from the respective one or more surfaces of the engaged circumferential side of the groove 70. In some embodiments, as shown, a single coated region 370 may contact and grind away sintered material from the second radially-outward-facing surface 90*b* of the groove 70. In other embodiments, multiple coated regions 370 may contact and grind away sintered material from one or more, or all, of the radially-outward-facing surfaces 90*a*, 90*b*, 90*c* of the groove 70. In still other embodiments, one or more coated regions 370 may contact and grind away sintered material from one or more, or all, of the radially-inward-facing surfaces 92*a*, 92*b*, 92*c* of the groove 70. In other embodiments, one or more coated regions 370 may contact and grind away sintered material from one or more, or all, of the circumferentially-inner surfaces 88*a*, 88*b*, 88*c* of the groove 70. In still other embodiments, multiple coated regions 370 may contact and grind away sintered material from one or more, or all, of the circumferentially-outer surfaces 86*a*, 86*b*, 86*c* of the groove 70. In other embodiments, one or more coated regions 370 may contact and grind away sintered material from the radially-inner surface 84 of the groove 70.

As the guide 320 passes through the groove 70 and the one or more coated regions 370 contacts and grinds away sintered material from the respective one or more surfaces of the engaged circumferential side of the groove 70, the surfaces of the non-coated regions of the guide 320 may be spaced apart from their corresponding surfaces of the groove 70. Once the sintered material has been removed by the one or more coated regions 370, one or more of the surfaces of the non-coated regions of the guide 320 may contact their corresponding surfaces of the groove 70, and such contact may prevent the one or more coated regions 370 from grinding or otherwise harming their corresponding surfaces of the groove 70 after removing the sintered material therefrom. It will be appreciated that the third tool 300 may be used to remove sintered material from respective surfaces of each of the circumferential sides of the groove 70, one side at a time. Further, it will be appreciated that multiple versions of the third tool 300 may be used when sintered material is present on multiple surfaces of the groove 70, with each version of the tool 300 having one or more coated regions 370 configured to grind sintered material from different surfaces of the groove 70. The grinding method may be carried out with respect to each of the grooves 70 of the rotor disk 60, one groove 70 at a time. Further aspects of the method of grinding away sintered material from the grooves 70 with the third tool 300 will be appreciated from the description of the tool 300 above.

The embodiments described herein thus provide improved tools and methods for cleaning the grooves of a turbine rotor disc of a gas turbine engine or a steam turbine engine. As described above, the tools and methods provided herein may allow maintenance personnel to quickly and efficiently remove contaminants from all desired surfaces of the rotor disk grooves. Additionally, such tools and methods may ensure that a substantially consistent degree of contaminant removal is achieved from one groove to another, even when the cleaning process is carried out by different maintenance personnel. Furthermore, such tools may be relatively inexpensive and easy to operate, and such methods may allow maintenance personnel to simultaneously clean or perform other work on other portions of the turbine rotor while the rotor disk grooves are being cleaned.

It should be apparent that the foregoing relates only to certain embodiments of the present application. Numerous changes and modifications may be made herein by one of ordinary skill in the art without departing from the general spirit and scope of the invention as defined by the following claims and the equivalents thereof.

We claim:

1. A system comprising a groove of a turbine rotor disk and a tool for cleaning the groove, the tool comprising:

a pair of guides spaced apart from one another in a direction of a longitudinal axis of the tool, wherein at least a portion of each guide has a cross-sectional profile corresponding to a cross-sectional profile of the groove; and a plurality of cleaning sheets positioned between the guides in the direction of the longitudinal axis of the tool, wherein at least a portion of each cleaning sheet has a cross-sectional profile corresponding to the cross-sectional profile of the groove;

wherein each cleaning sheet comprises a plurality of recesses extending in the direction of the longitudinal axis of the tool, and a plurality of shoulders extending in the direction of the longitudinal axis of the tool;

wherein each cleaning sheet comprises:

a bottom surface positioned along a bottom side of the tool;

a plurality of laterally-outer surfaces positioned along lateral sides of the tool;

a plurality of laterally-inner surfaces positioned along the lateral sides of the tool;

a plurality of top-facing surfaces positioned along the lateral sides of the tool and facing a top side of the tool; and a plurality of bottom-facing surfaces positioned along the lateral sides of the tool and facing the bottom side of the tool;

wherein each cleaning sheet comprises one or more contact portions configured to contact one or more surfaces of the groove, and one or more non-contact portions configured to not contact remaining surfaces of the groove;

wherein each contact portion comprises a plurality of fingers, and a slot separating each adjacent pair of the fingers.

2. The system of claim 1, wherein each guide comprises a plurality of slots extending in the direction of the longitudinal axis of the tool, and a plurality of ribs extending in the direction of the longitudinal axis of the tool.

3. The system of claim 1, wherein the cleaning sheets are spaced apart from one another in the direction of the longitudinal axis of the tool.

4. The system of claim 1, wherein the plurality of cleaning sheets comprises:

a first cleaning sheet comprising a first contact portion and a first non-contact portion; and a second cleaning sheet comprising a second contact portion and a second non-contact portion;

wherein the first contact portion is different than the second contact portion; and wherein the first non-contact portion is different than the second non-contact portion.

5. The system of claim 1, wherein the plurality of cleaning sheets comprises:

a first cleaning sheet, wherein the one or more contact portions of the first cleaning sheet includes the bottom surface thereof, and wherein the one or more non-contact portions of the first cleaning sheet includes the laterally-outer surfaces, the laterally-inner surfaces, the top-facing surfaces, and the bottom-facing surfaces thereof;

a second cleaning sheet, wherein the one or more contact portions of the second cleaning sheet includes the laterally-outer surfaces thereof, and wherein the one or more non-contact portions of the second cleaning sheet includes the bottom surface, the laterally-inner surfaces, the top-facing surfaces, and the bottom-facing surfaces thereof;

a third cleaning sheet, wherein the one or more contact portions of the third cleaning sheet includes the laterally-inner surfaces thereof, and wherein the one or more non-contact portions of the third cleaning sheet includes the bottom surface, the laterally-outer surfaces, the top-facing surfaces, and the bottom-facing surfaces thereof;

a fourth cleaning sheet, wherein the one or more contact portions of the fourth cleaning sheet includes the top-facing surfaces thereof, and wherein the one or more non-contact portions of the fourth cleaning sheet includes the bottom surface, the laterally-inner surfaces, the laterally-outer surfaces, and the bottom-facing surfaces thereof; and a fifth cleaning sheet, wherein the one or more contact portions of the fifth cleaning sheet includes the bottom-facing surfaces thereof, and wherein the one or more non-contact portions of the fifth cleaning sheet includes the bottom surface, the laterally-inner surfaces, the laterally-outer surfaces, and the top-facing surfaces thereof.

6. The system of claim 1, wherein the one or more contact portions of each cleaning sheet are configured to contact fewer than all of the surfaces of the groove, and wherein the contact portions of the plurality of cleaning sheets are configured to collectively contact all of the surfaces of the groove.

7. The system of claim 1, wherein the guides are formed of a rigid material, and wherein the cleaning sheets are formed of a flexible material.

8. The system of claim 1, further comprising:

a guide mount rigidly attached to each of the guides; and a handle rigidly attached to the guide mount.

9. A system comprising a groove of a turbine rotor disk and a number of tools for cleaning the groove, the system comprising:

a first tool comprising:

a pair of guides spaced apart from one another in a direction of a longitudinal axis of the first tool, wherein at least a portion of each guide of the first tool has a cross-sectional profile corresponding to a cross-sectional profile of the groove; and a plurality of cleaning sheets positioned between the guides of the first tool in the direction of the longitudinal axis of the first tool, wherein at least a portion of each cleaning sheet has a cross-sectional profile corresponding to the cross-sectional profile of the groove; and a second tool comprising:

a pair of guides spaced apart from one another in a direction of a longitudinal axis of the second tool, wherein at least a portion of each guide of the second tool has a cross-sectional profile corresponding to the cross-sectional profile of the groove; and a cleaning brush positioned between the guides of the second tool in the direction of the longitudinal axis of the second tool, wherein at least a portion of the cleaning brush has a cross-sectional profile corresponding to the cross-sectional profile of the groove.

10. The system of claim 9, wherein each guide of the first tool comprises a plurality of slots extending in the direction of the longitudinal axis of the first tool, and a plurality of ribs extending in the direction of the longitudinal axis of the first tool, wherein each guide of the second tool comprises a plurality of slots extending in the direction of the longitudinal axis of the second tool, and a plurality of ribs extending in the direction of the longitudinal axis of the second tool, wherein each cleaning sheet comprises a plurality of recesses extending in the direction of the longitudinal axis of the first tool, and a plurality of shoulders extending in the direction of the longitudinal axis of the first tool, and wherein the cleaning brush comprises a plurality of recesses extending along a circumference of the cleaning brush, and a plurality of shoulders extending along the circumference of the cleaning brush.

11. The system of claim 9, further comprising:

a third tool comprising:

a guide extending along a longitudinal axis of the third tool, wherein at least a portion of the guide of the third tool has a cross-sectional profile corresponding to the cross-sectional profile of the groove; and a coated region positioned along one or more surfaces of the guide of the third tool, wherein the coated region comprises a coating formed of an abrasive material.

* * * * *